US012507845B2

(12) United States Patent
Laundre

(10) Patent No.: US 12,507,845 B2
(45) Date of Patent: Dec. 30, 2025

(54) TOILET SEAT HINGE ASSEMBLY WITH AIR CLEANER

(71) Applicant: Kohler Co., Kohler, WI (US)

(72) Inventor: Jeffrey T. Laundre, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 512 days.

(21) Appl. No.: 17/949,669

(22) Filed: Sep. 21, 2022

(65) Prior Publication Data

US 2023/0109596 A1 Apr. 6, 2023

Related U.S. Application Data

(60) Provisional application No. 63/252,697, filed on Oct. 6, 2021.

(51) Int. Cl.

| | |
|---|---|
| ***A47K 13/30*** | (2006.01) |
| ***A47K 13/12*** | (2006.01) |
| ***E03D 9/00*** | (2006.01) |

(52) U.S. Cl.

CPC ..... *A47K 13/30* (2013.01); *A47K 13/12* (2013.01); *E03D 9/005* (2013.01)

(58) Field of Classification Search

None

See application file for complete search history.

(56) References Cited

U.S. PATENT DOCUMENTS

| | | | |
|---|---|---|---|
| 3,837,018 | A | 9/1974 | Haberle |
| 4,063,316 | A | 12/1977 | Hunninghaus |
| 4,536,899 | A | 8/1985 | Schnyder |
| 4,790,036 | A | 12/1988 | Vogeli et al. |
| 4,790,039 | A | 12/1988 | Speer |
| 4,873,729 | A | 10/1989 | Micallef |
| 4,953,238 | A | 9/1990 | Shifferly |
| 5,031,252 | A | 7/1991 | Oyama |
| 6,076,197 | A | 6/2000 | Yeung |
| 7,028,346 | B2 | 4/2006 | Ermini |

(Continued)

FOREIGN PATENT DOCUMENTS

| | | | |
|---|---|---|---|
| CN | 2296691 | Y | 11/1998 |
| CN | 2307845 | Y | 2/1999 |

(Continued)

OTHER PUBLICATIONS

Extended European Search Report from European Patent Application No. 22199194.6, dated May 10, 2023, 10 pages.

(Continued)

*Primary Examiner* — Christine J Skubinna

(74) *Attorney, Agent, or Firm* — Lempia Summerfield Katz LLC

(57) ABSTRACT

A toilet seat assembly encloses a toilet bowl. The toilet seat assembly includes a toilet seat, a fan, a wick compartment, an atomizer, and at least one baffle. The toilet seat rotatably is connected to the toilet bowl via a hinge. The fan is configured to direct a flow of air into a hinge structure. The wick compartment in the hinge structure includes a sanitizing fluid. The atomizer is configured to spray fine particles of the sanitizing fluid into the flow of air from the fan. The at least one baffle is configured to direct the flow of air including the fine particles of the sanitizing fluid toward a surface of the toilet seat.

17 Claims, 37 Drawing Sheets

(56) References Cited

U.S. PATENT DOCUMENTS

| | | | | |
|---|---|---|---|---|
| 8,381,321 | B2 | 2/2013 | Nishizaki et al. | |
| 8,769,729 | B2 | 7/2014 | Nishimura et al. | |
| 10,299,641 | B2 | 5/2019 | Käppeli et al. | |
| 10,557,259 | B2 | 2/2020 | Park et al. | |
| 10,563,388 | B2 | 2/2020 | Nogoshi et al. | |
| 10,570,599 | B2 | 2/2020 | Nogoshi et al. | |
| 10,584,469 | B2 | 3/2020 | Nogoshi et al. | |
| 10,590,639 | B2 | 3/2020 | Nogoshi et al. | |
| 10,597,857 | B2 | 3/2020 | Nogoshi et al. | |
| 2006/0021121 | A1 | 2/2006 | Moussa | |
| 2008/0060119 | A1 | 3/2008 | Pinizzotto | |
| 2012/0227171 | A1 | 9/2012 | Lopez | |
| 2017/0058500 | A1* | 3/2017 | Garrels | E03D 9/05 |
| 2020/0054179 | A1 | 2/2020 | Ruehle | |
| 2020/0337509 | A1 | 10/2020 | Ho | |
| 2020/0375417 | A1* | 12/2020 | Thorne | A47K 13/24 |
| 2022/0112704 | A1* | 4/2022 | Garrels | B03C 3/49 |
| 2023/0144681 | A1* | 5/2023 | Dorra | E03D 9/007 4/233 |

FOREIGN PATENT DOCUMENTS

| | | | |
|---|---|---|---|
| CN | 1446123 | A | 10/2003 |
| CN | 1791471 | A | 6/2006 |
| CN | 2793177 | Y | 7/2006 |
| CN | 101932877 | A | 12/2010 |
| CN | 201679072 | U | 12/2010 |
| CN | 101474049 | B | 4/2011 |
| CN | 202005706 | U | 10/2011 |
| CN | 101933782 | B | 2/2012 |
| CN | 202154629 | U | 3/2012 |
| CN | 101543386 | B | 5/2012 |
| CN | 101933781 | B | 5/2012 |
| CN | 202269973 | U | 6/2012 |
| CN | 202526067 | U | 11/2012 |
| CN | 203776819 | U | 8/2014 |
| CN | 204133361 | U | 2/2015 |
| CN | 204797727 | U | 11/2015 |
| CN | 106388684 | A | 2/2017 |
| CN | 106388685 | A | 2/2017 |
| CN | 106480949 | A | 3/2017 |
| CN | 106480950 | A | 3/2017 |
| CN | 106677302 | A | 5/2017 |
| CN | 206298941 | U | 7/2017 |
| CN | 206408707 | U | 8/2017 |
| CN | 206424039 | U | 8/2017 |
| CN | 107468142 | A | 12/2017 |
| CN | 107518819 | A | 12/2017 |
| CN | 206745303 | U | 12/2017 |
| CN | 207253298 | U | 4/2018 |
| CN | 106108758 | B | 8/2018 |
| CN | 108478084 | A | 9/2018 |
| CN | 108497984 | A | 9/2018 |
| CN | 106245727 | B | 1/2019 |
| CN | 106491034 | B | 1/2019 |
| CN | 109199204 | A | 1/2019 |
| CN | 208404365 | U | 1/2019 |
| CN | 104288805 | B | 5/2019 |
| CN | 109744928 | A | 5/2019 |
| CN | 110130453 | A | 8/2019 |
| CN | 110179383 | A | 8/2019 |
| CN | 106618356 | B | 12/2019 |
| CN | 209808181 | U | 12/2019 |
| CN | 209899246 | U | 1/2020 |
| CN | 209989893 | U | 1/2020 |
| CN | 108222166 | B | 4/2020 |
| CN | 210369193 | U | 4/2020 |
| CN | 111110094 | A | 5/2020 |
| CN | 210507684 | U | 5/2020 |
| CN | 210520885 | U | 5/2020 |
| CN | 210541282 | U | 5/2020 |
| CN | 210658584 | U | 6/2020 |
| CN | 111441440 | A | 7/2020 |
| CN | 211049238 | U | 7/2020 |
| CN | 211534196 | U | 9/2020 |
| CN | 112814106 | A | 5/2021 |
| DE | 2519337 | A1 | 11/1976 |
| DE | 2523782 | A1 | 12/1976 |
| DE | 2621802 | A1 | 12/1977 |
| DE | 2908000 | A1 | 1/1981 |
| DE | 2927076 | A1 | 1/1981 |
| DE | 4027337 | C2 | 3/1993 |
| DE | 20007073 | U1 | 9/2000 |
| DE | 10231756 | A1 | 1/2004 |
| DE | 102005004045 | A1 | 5/2007 |
| EP | 0741210 | A1 | 11/1996 |
| FR | 2314698 | A1 | 1/1977 |
| FR | 2572919 | A1 | 5/1986 |
| FR | 2589497 | A1 | 5/1987 |
| FR | 2603315 | A1 | 3/1988 |
| FR | 2696200 | A1 | 4/1994 |
| FR | 2707473 | B1 | 1/1998 |
| FR | 2710252 | B1 | 1/1998 |
| FR | 2871045 | B1 | 11/2008 |
| GB | 923222 | A | 4/1963 |
| JP | H01284220 | A | 11/1989 |
| JP | H039712 | A | 1/1991 |
| JP | H039713 | A | 1/1991 |
| JP | H039714 | A | 1/1991 |
| JP | H03244419 | A | 10/1991 |
| JP | H04208124 | A | 7/1992 |
| JP | 01297028 | A | 4/1993 |
| JP | H05329066 | A | 12/1993 |
| JP | H06181863 | A | 7/1994 |
| JP | 2005261880 | A | 9/2005 |
| JP | 2014236948 | A | 12/2014 |
| JP | 2018087466 | A | 6/2018 |
| JP | 2019027065 | A | 2/2019 |
| JP | 2019112816 | A | 7/2019 |
| JP | 2019112817 | A | 7/2019 |
| JP | 2019112818 | A | 7/2019 |
| JP | 2019166201 | A | 10/2019 |
| JP | 2019167790 | A | 10/2019 |
| JP | 2019170522 | A | 10/2019 |
| JP | 2019170523 | A | 10/2019 |
| JP | 2019170524 | A | 10/2019 |
| JP | 2019170525 | A | 10/2019 |
| JP | 2019170526 | A | 10/2019 |
| JP | 2019173539 | A | 10/2019 |
| JP | 2020037781 | A | 3/2020 |
| JP | 2020171468 | A | 10/2020 |
| KR | 200168469 | Y1 | 2/2000 |
| KR | 200311836 | Y1 | 5/2003 |
| KR | 200344348 | Y1 | 3/2004 |
| KR | 100585485 | B1 | 6/2006 |
| KR | 100773599 | B1 | 11/2007 |
| KR | 200438841 | Y1 | 3/2008 |
| KR | 20080003606 | U | 8/2008 |
| KR | 100906512 | B1 | 7/2009 |
| KR | 101041778 | B1 | 6/2011 |
| KR | 20110005493 | U | 6/2011 |
| KR | 20110132928 | A | 12/2011 |
| KR | 101168578 | B1 | 7/2012 |
| KR | 101191973 | B1 | 10/2012 |
| KR | 101201914 | B1 | 11/2012 |
| KR | 101208056 | B1 | 12/2012 |
| KR | 101254769 | B1 | 4/2013 |
| KR | 20140090380 | A | 7/2014 |
| KR | 101518863 | B1 | 5/2015 |
| KR | 101518864 | B1 | 5/2015 |
| KR | 101538436 | B1 | 7/2015 |
| KR | 200478243 | Y1 | 9/2015 |
| KR | 20160054725 | A | 5/2016 |
| KR | 101675060 | B1 | 11/2016 |
| KR | 101729571 | B1 | 5/2017 |
| KR | 101781848 | B1 | 9/2017 |
| KR | 102025342 | B1 | 9/2019 |
| KR | 102157307 | B1 | 9/2020 |
| KR | 20200115085 | A | 10/2020 |
| TW | M578312 | U | 5/2019 |
| WO | 2000027269 | A1 | 5/2000 |

(56) References Cited

FOREIGN PATENT DOCUMENTS

| | | | |
|---|---|---|---|
| WO | 2003015597 | A1 | 2/2003 |
| WO | 2008024005 | A2 | 2/2008 |
| WO | 2015024549 | A1 | 2/2015 |

OTHER PUBLICATIONS

Chinese Office Action from Chinese Patent Application No. 2025052200034240, 15 pages. (including English summary).
Extended European Search Report from European Patent Application No. 22 199 194.6 - 1005, dated Mar. 26, 2025, 4 pages.

* cited by examiner

TOILET SEAT HINGE ASSEMBLY WITH AIR CLEANER

This application claims priority benefit of Provisional Application No. 63/252,697 filed Oct. 6, 2021, which is hereby incorporated by reference in its entirety.

FIELD

The present application relates generally to a toilet seat assembly to reduce or prevent an air plume from being expelled from a toilet bowl.

BACKGROUND

Generally, air includes very small particles or droplets that are suspended in the air. These aerosols are particularly prevalent in enclosed spaces, and even more prevalent in enclosed spaces with water usage. For example, in a bathroom aerosols may be expelled from several places, not the least of which is the toilet, which may be referred to as a toilet plume.

Aerosols may be removed from the air that humans breathe by the human body's respiratory system. However, some aerosols may be toxic or even carry a virus into the human body. The problem of aerosols may be mitigated through sanitization of the air. It would be advantageous to provide a toilet having internal sealing systems that prevent the toilet plume from being expelled from the toilet.

BRIEF DESCRIPTION OF THE DRAWINGS

Exemplary embodiments are described herein with reference to the following drawings, according to an exemplary embodiment.

DETAILED DESCRIPTION

The following embodiments includes systems, apparatus, and methods for sanitization and/or disinfection of one or more surfaces and/or one or more spaces associated with a toilet bowl. Regarding the toilet, two specific areas that are targeted include management of the plume and sanitization of the surfaces of the toilet, or at least the surfaces that the human body comes in contact with. The plume is a cloud of microscopic particles or droplets dispersed into the air as a result of flushing the toilet. The plume may include bacteria, germs, or fecal matter. Every person who uses a toilet comes in contact with either the seat or lid. That person not only potentially spreads their germs to those surfaces but also has the risk of spreading the germs to others.

The following systems, apparatus, and method for sanitization and/or disinfection may be incorporated into a toilet seat assembly. Generally, the toilet seat assembly may include a cover, a seat, and one or more passageways or cavities configured for the conveyance of a sanitizing fluid.

Example sanitizing fluids may include disinfectant, sanitizing agent, or another solution. The tank may include an opening to receive the disinfectant into the tank. The disinfectant may be hydrogen peroxide ($H_2O_2$). Hydrogen peroxide is antiviral and antibacterial. Hydrogen peroxide is an example antiseptic because hydrogen peroxide may kill bacteria cells by destroying the cell's walls. It is also more effective than chlorine bleach at reaching and killing mold on porous surfaces. To use as a disinfectant, hydrogen peroxide may be applied to the surface and simply allowed to air dry. Other solutions that may be stored in the tank may include quaternary ammonium, tetraacetyl ethylenediamine, phenolic, isopropyl alcohol, sodium carbonate, peroxyhydrate; tetraacetyl ethylenediamine, ethanol, sodium hypochlorite, octanoic acid, or sodium chlorite.

As one alternative to these chemical solutions, the tank may include electrolyzed water. Electrolyzed water may be referred to as electrolyzed oxidizing water, electro-activated water or electro-chemically activated water solution. Electrolyzed water may be generated by the electrolysis of water (e.g., ordinary water or tap water) with dissolved sodium chloride therein. The electrolysis may produce hypochlorous acid and sodium hydroxide. The electrolysis may include apply a direct current (DC) power source connected to multiple electrodes plates constructed from electroconductive material such as metal.

Figure 1A:
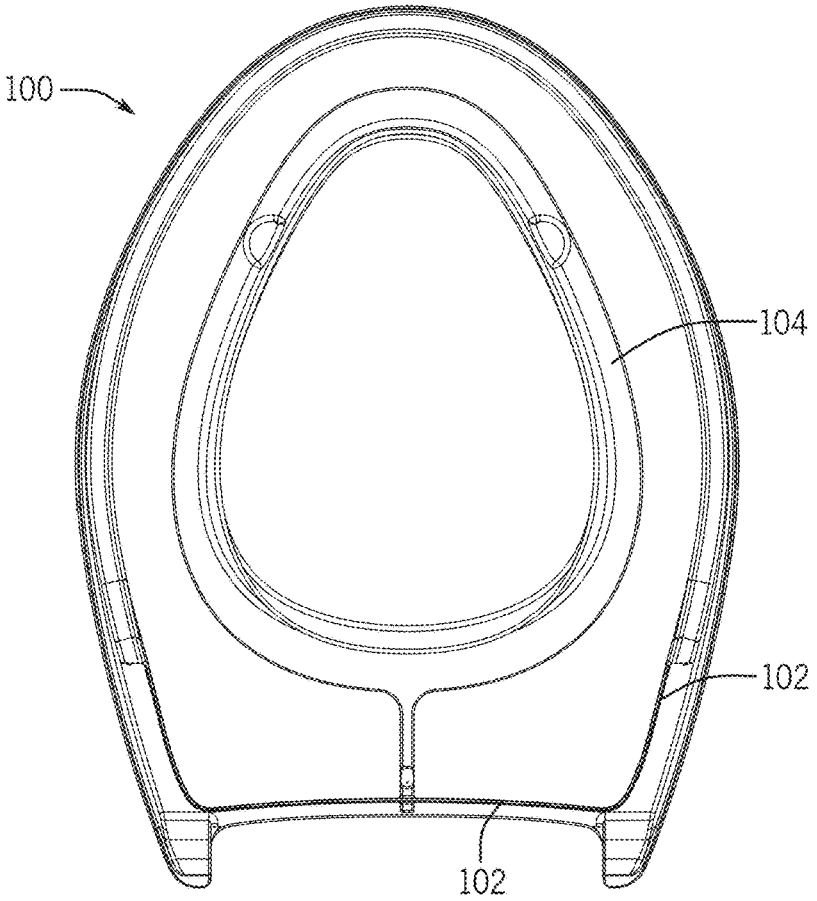
FIG. 1A illustrates an example toilet seat.
Figure 1B:
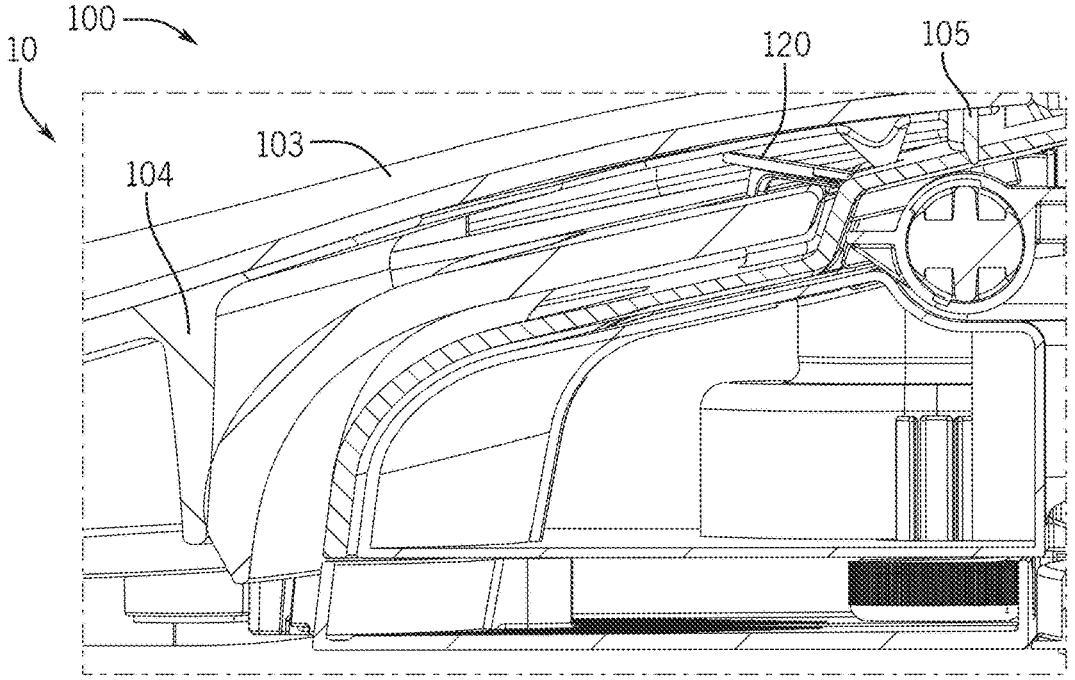
FIG. 1B illustrates an example toilet seat and gasket system.
Figure 2A:
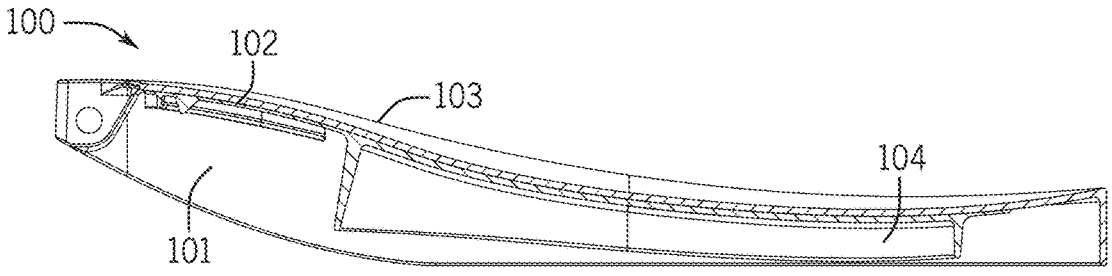
FIG. 2A illustrates an example toilet seat assembly.
Figure 2B:
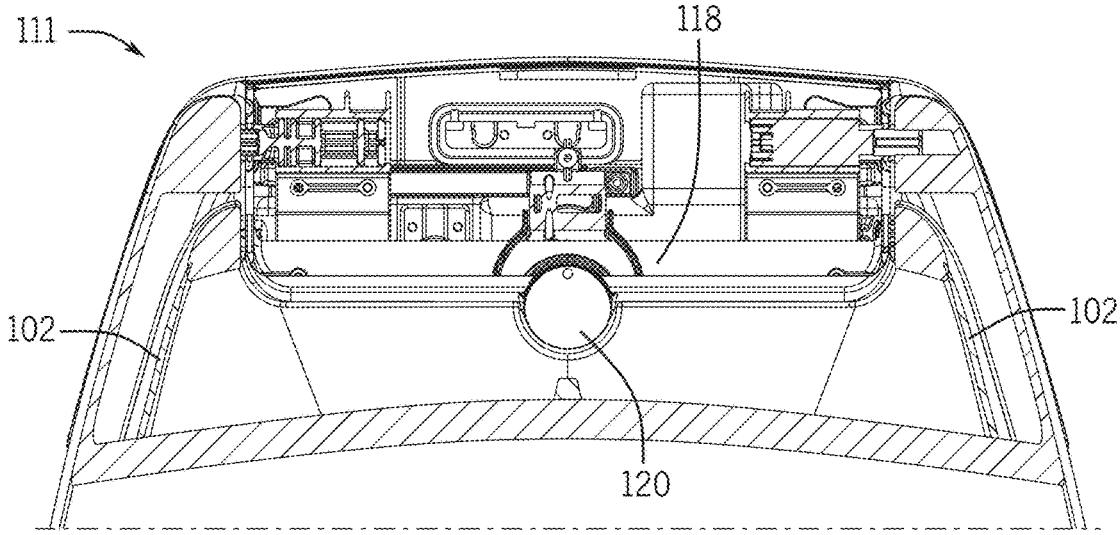
FIG. 2B illustrates an example hinge of the toilet seat assembly.
Figure 2C:
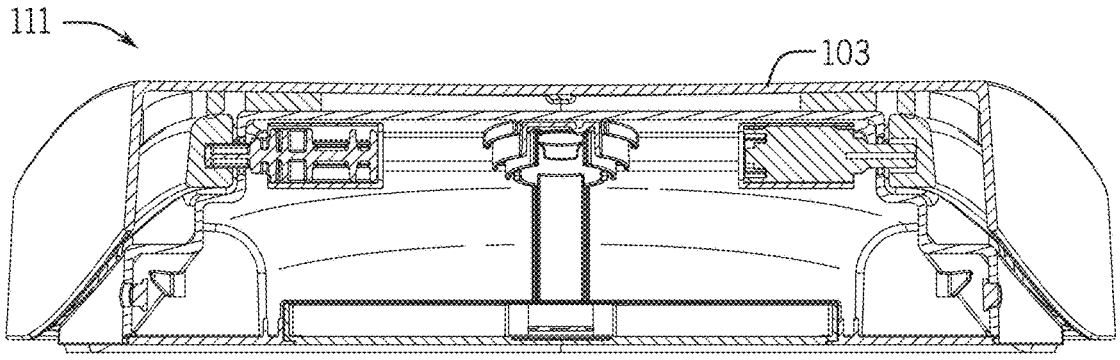
FIG. 2C illustrates an example rear view of the hinge.

FIG. 1A and FIG. 1B illustrates an example toilet seat 100 and gasket system including a first seal (gasket) 112 and a second seal 104 (gasket). FIG. 2A illustrates an example toilet seat assembly. FIG. 2B illustrates an example hinge section 111 of the toilet seat assembly. FIG. 2C illustrates an example rear view of the hinge section 111.

FIG. 1B illustrates a hinge assembly 10, which may be behind the toilet seat 100 and under the lid 103. The toilet seat 100 is rotatably connected to a toilet bowl via a hinge. A hinge assembly or section 111 may include one or more sanitization components as described herein.

FIG. 1B also illustrates a valve 120 engageable by a protrusion of the lid 103, which are discussed in more detail below. The lid 103 may include a sidewall that encloses the toilet seat 100. As described in the foregoing examples, the sanitizing fluid may leave the toilet seat assembly in one or both of two paths. A first path, through one or more channels or apertures, allows the sanitizing fluid to flow from the tank of the toilet seat assembly into the bowl. A second path, through the valve 120 allows the sanitizing fluid to flow to the toilet seat 100.

The first seal 112 may be a hinge seal configured to seal a space between the toilet seat 100 and a rim of the toilet bowl. The hinge seal may be connected to the hinge and/or incorporated into the hinge assembly or section. The first seal 112 may be a baffle that partially slows or prevents the flow of the sanitizing material into the bowl.

The second seal 104 may be a perimeter seal slidably engaged with a lip of the toilet seat 100. FIG. 1B also illustrates a rib 105 that prevents the sanitizing fluid and/or plume from escaping through or over the hinge. In some examples the rib 105 is a third seal and in other examples the second seal 104 and rib 105 are integrated into a single component.

On the lid 103, the inner integrated lid baffle design (e.g., second seal 104) may optimize $H_2O_2$ usage and sanitization efficacy (overmolded or could also be coupled via welding/adhesives). In addition, the rear lid perimeter seal (e.g., first seal 112) may prevent plume from escaping over the hinge area. The rear lid perimeter seal may also include side wrapping geometry.

On the ring or toilet seat 100, mechanical extrusion wiper seal (e.g., thermoplastic elastomers TPE or thermoplastic vulcanizate TPV soft material) along perimeter of the ring provides an easy to install, low cost, and serviceable gasket design. On the ring or toilet seat 100, a wiper seal is to help retain $H_2O_2$ fog during fogging process to improve the efficiency of surface organism kill rate and lessens chemistry required for efficacy.

Figure 3A:
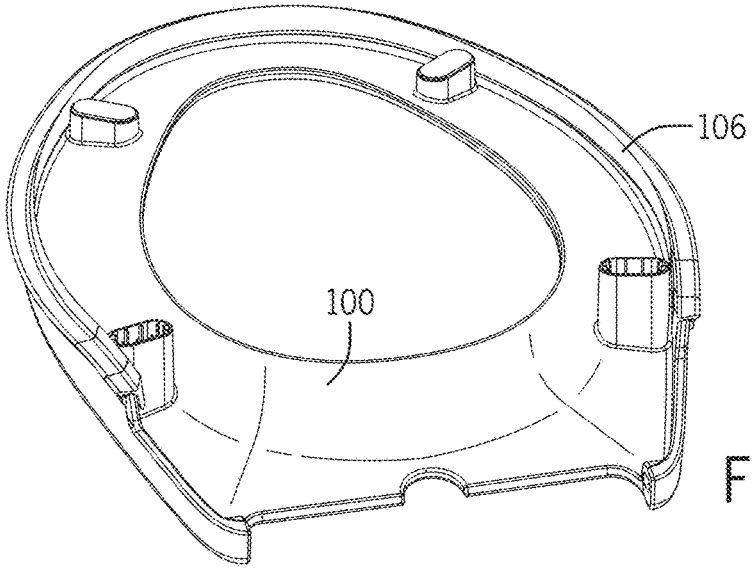
FIG. 3A illustrate an example outer gasket for the toilet seat.
Figure 3B:
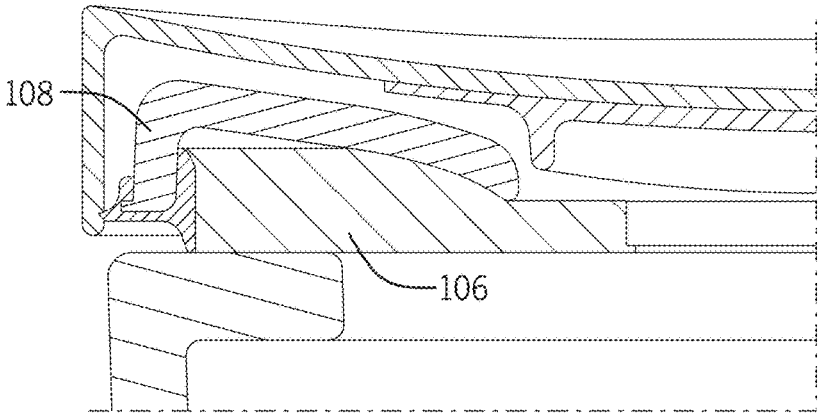
FIGS. 3B and 3C illustrate the details of the outer gasket.
Figure 3C:
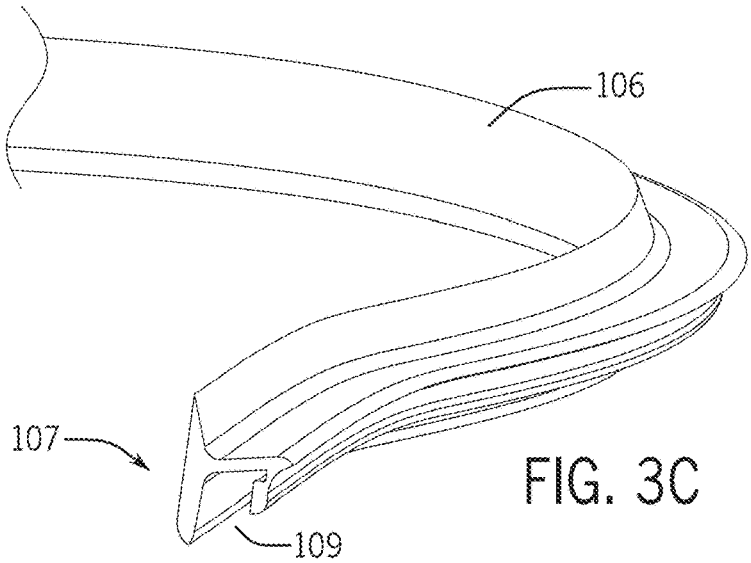

FIG. 3A illustrates an example outer gasket 106 for the toilet seat. The outer gasket 106 may be an outer perimeter seal coupled to the lid and configured to engage the toilet seat 100. FIGS. 3B and 3C illustrate the details of the outer gasket 106. The outer gasket 106 may include an engagement portion 107 including a groove 109 that mates with a track 108 of the toilet seat 100. The track 108 may include a lip or another protrusion that fits within the groove 109 of the outer gasket 106 or otherwise slidably engages the outer gasket 106.

Figure 4:
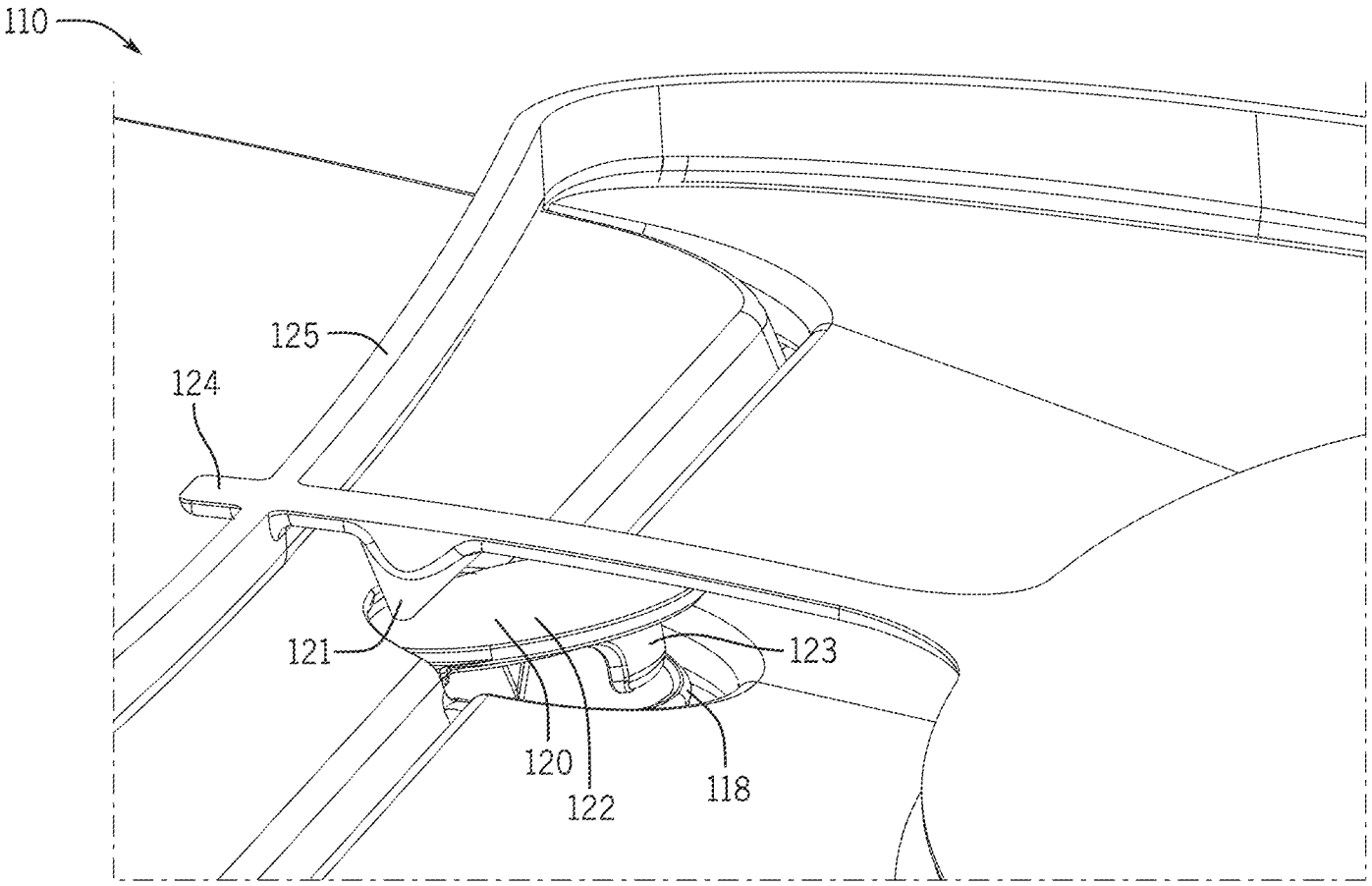
FIG. 4 illustrates operation of a valve for a sanitizing fluid.

FIG. 4 illustrates operation of a valve 120 (e.g., pop-up feature) for a sanitizing fluid. The valve 120 reveals an opening into a tank 118. The valve 120 is operable to contain or release the sanitizing fluid. The valve 120 may meter or control the flow of the sanitizing fluid. The valve 120 may include a cap 122 and a limiter 123. The lid 103 includes a protrusion 121 at a predetermined position to engage with the valve 120 and release a sanitizing material into the toilet bowl. The protrusion 121 may be positioned according to a first brace 124 and a second brace 125 of the lid 103 that are arranged to align the protrusion 121 with the valve 120. The valve 120 is operable in a first position to at least partially prevent the sanitizing material from exiting the tank 118 and a second position to release the sanitizing material from the tank 118 into the toilet bowl when engaged by the protrusion 121.

Figure 5:
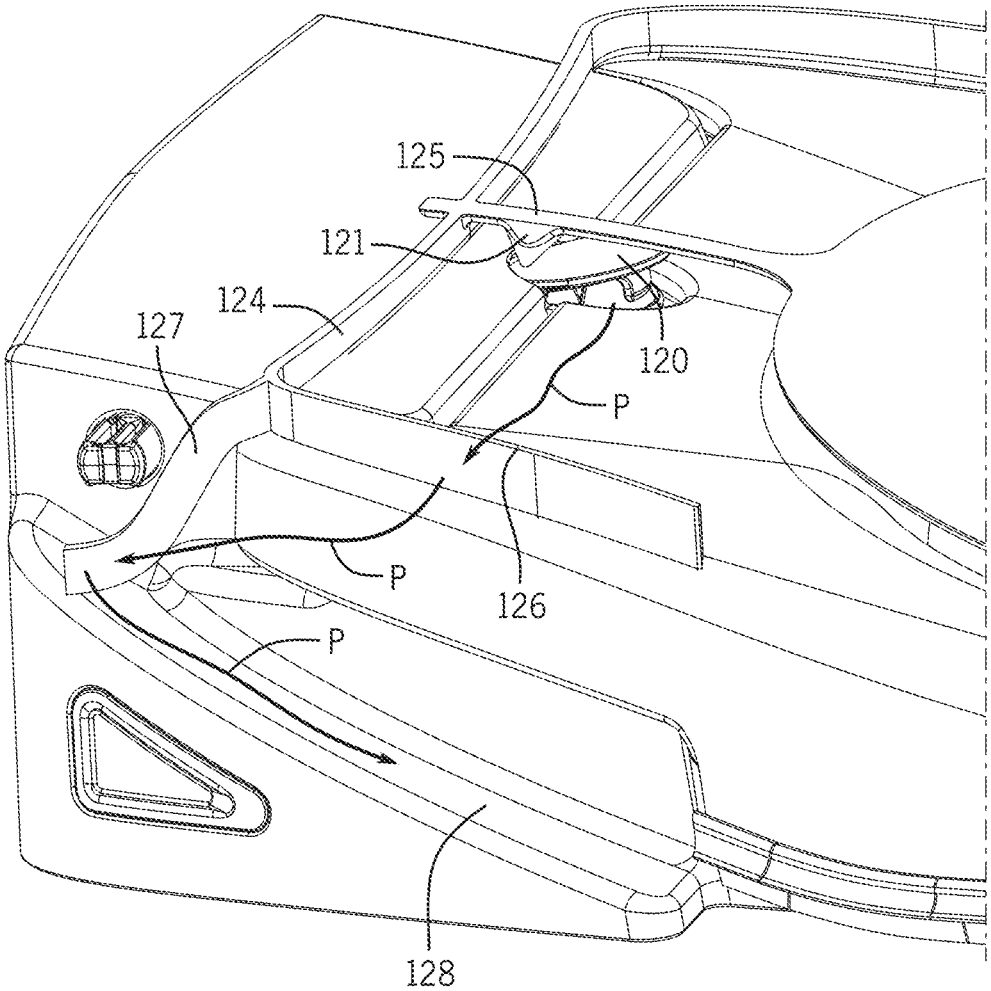
FIG. 5 illustrates a path for the sanitizing fluid.
Figure 6:
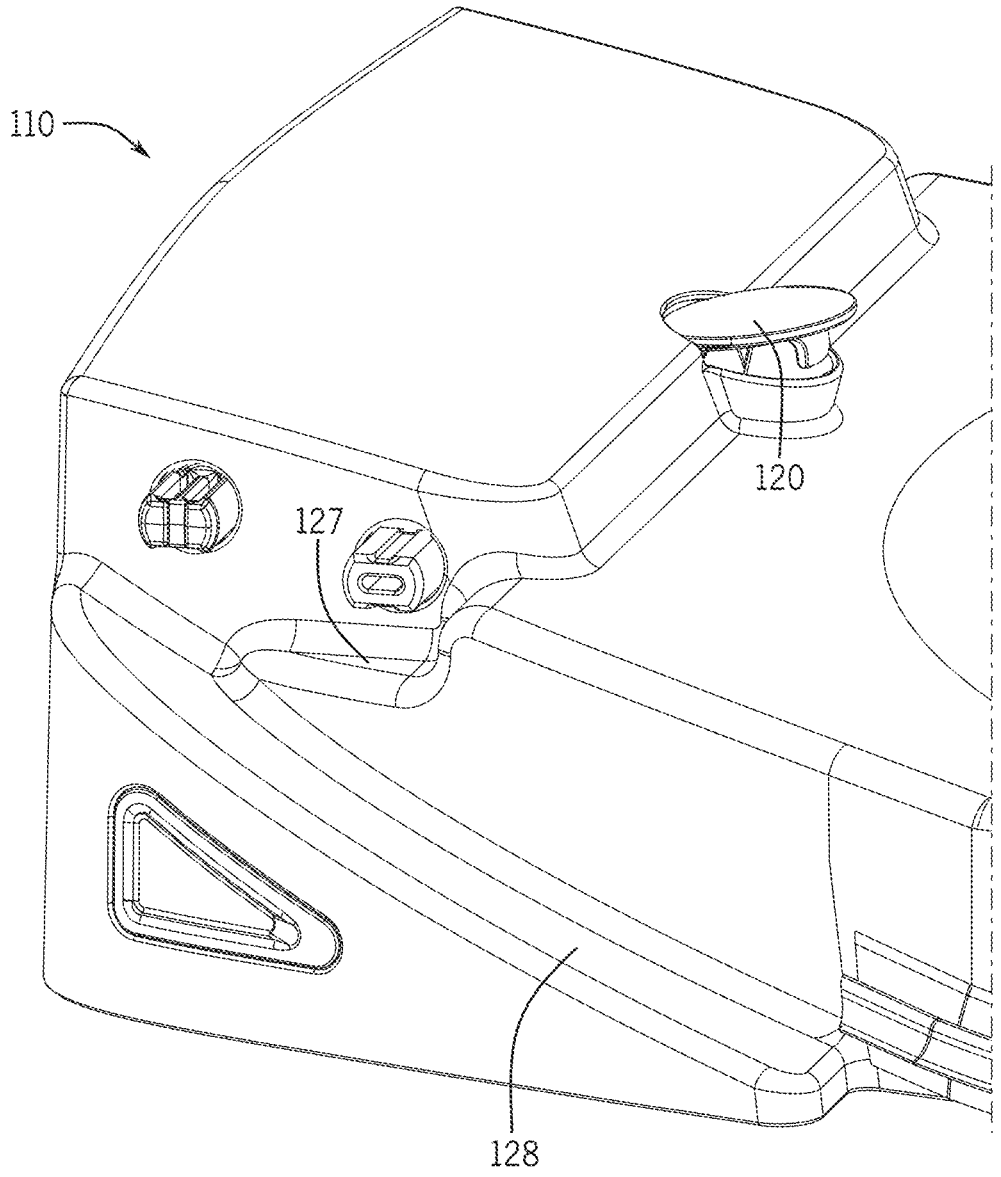
FIG. 6 illustrates hardware for the path for the sanitizing fluid.

FIG. 5 illustrates a path P for the sanitizing fluid. The path P may be determined by at least one ridge feature 126. The path P may be determined by at least one step feature 127. The path P may be determined by at least one channel feature 128. FIG. 6 illustrates another view of hardware for the path P for the sanitizing fluid including the step feature 127 and the channel feature 128. The path P may be defined by open areas in rear of seat assembly, which enables recovery air for siphonic toilets to flush without issue. Geometries in hinge cover may be configured to all fogged air to escape and be cleaned per fogging cycle. In some examples, fogged $H_2O_2$ may flow in a manner similar to liquid and drain onto potentially dirty surfaces.

The channel feature 128 may provide multiple advantages. At one point in the flush cycle and/or cleaning cycle, the channel 128 is configured to provide air recovery for a siphonic flush. At one point in the flush cycle and/or cleaning cycle, the channel 128 is configured to provide the sanitizing fluid to the toilet bowl.

The channel feature 128 may be a passageway that provides a liquid overflow channel if a user refills too much sanitizing fluid into the tank and ensure fogging device stays above the waterline. Passageway also enables odor abatement solution by use of running the fan during use as $H_2O_2$ vapor (via fogging device or fan air flow through the tank) to eliminate odors and flow through the filter (electrostatic or other filtering technology).

Figure 7A:
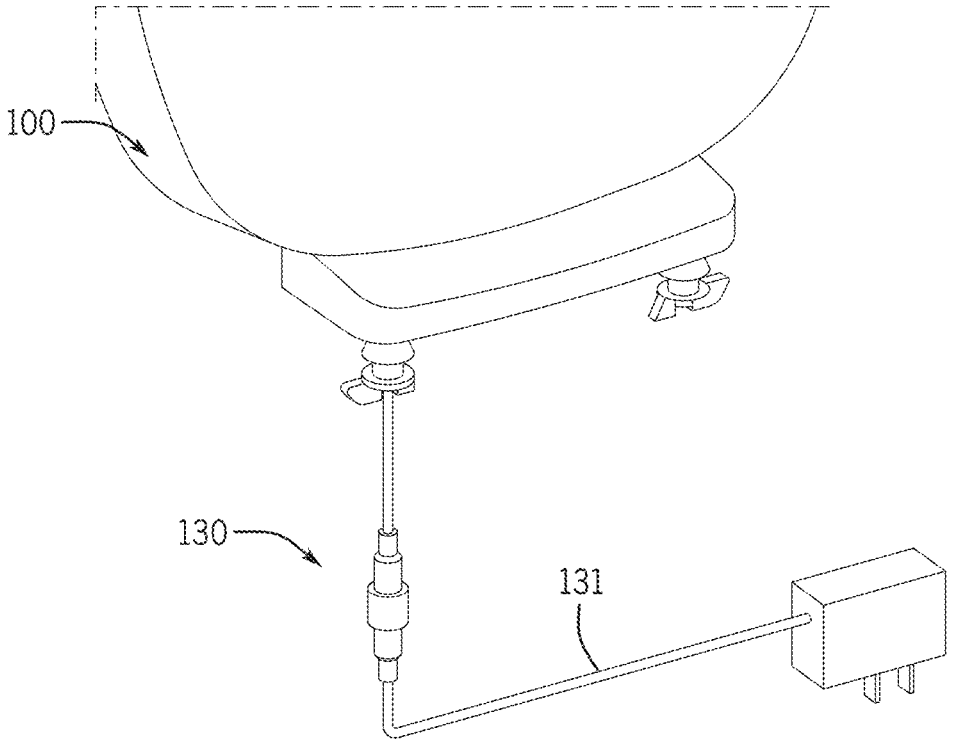
FIGS. 7A and 7B illustrates an example electrical connection for the toilet seat assembly.
Figure 7B:
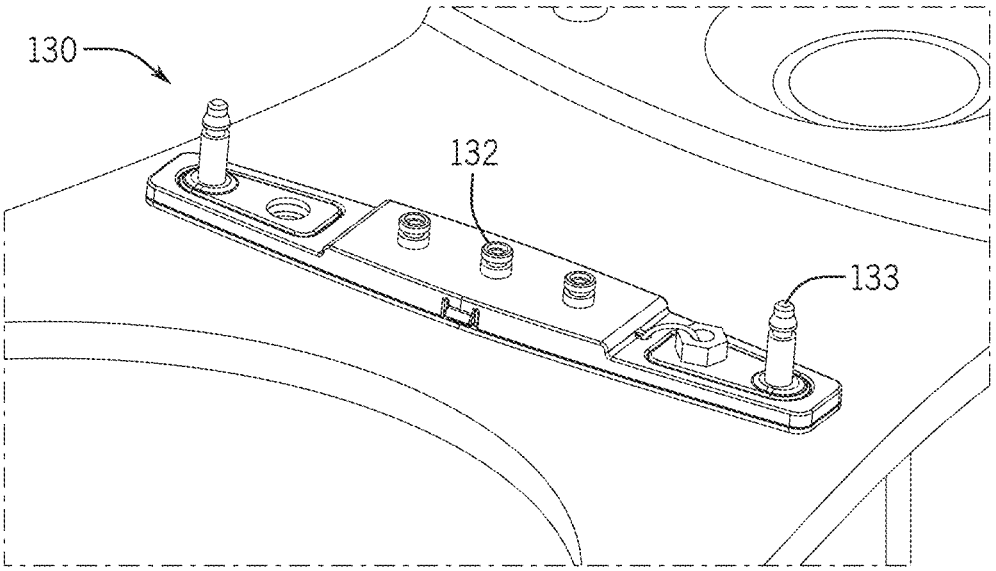
Figure 8A:
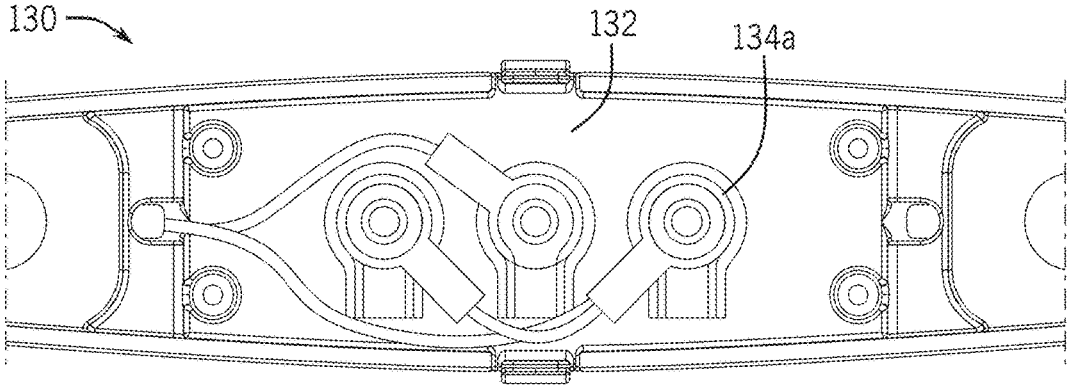
FIGS. 8A-8D illustrates example mounting plates for the electrical connection.
Figure 8B:
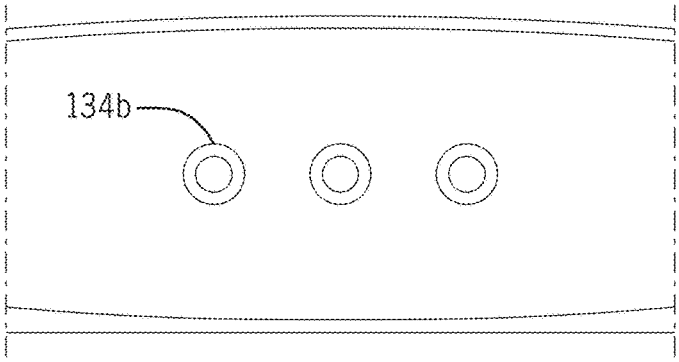
Figure 8C:
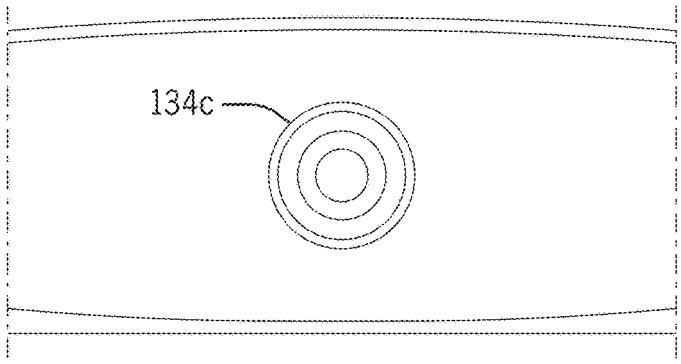
Figure 8D:
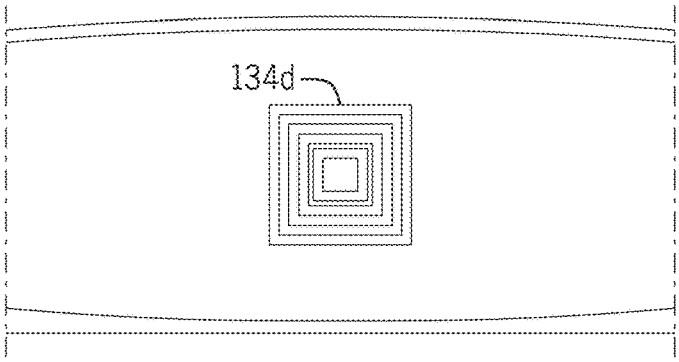

FIGS. 7A and 7B illustrates an example electrical connection for the toilet seat assembly. A power supply 130 may include a plug and wire 131 to connect to the toilet seat assembly. The power supply 130 may suppled an electric current to any of the devices described herein including a fan, a fog generator, or an electrolyzer. One of the posts 133 for mounting the toilet seat assembly may be connected to the wire 131 and provide the electrical current therethrough. The mounting plate 132 may be reversible so that the power supply 130 and wire 131 may be provide on either side of the toilet seat assembly and either side of the toilet.

Figure 9A:
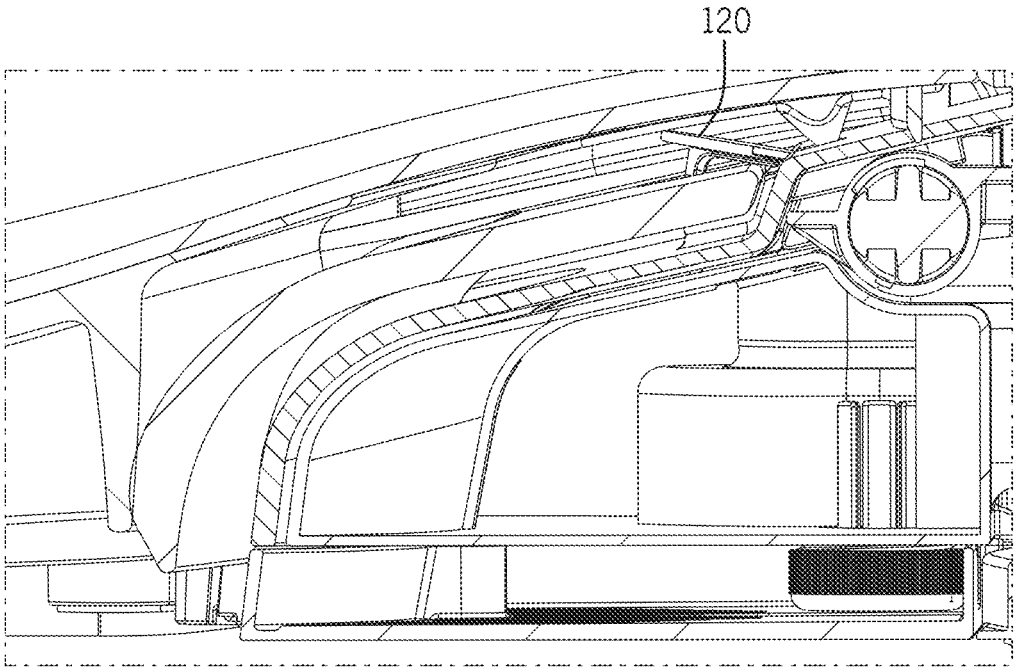
FIGS. 9A and 9B illustrate an example mechanical valve for the sanitizing fluid.
Figure 9B:
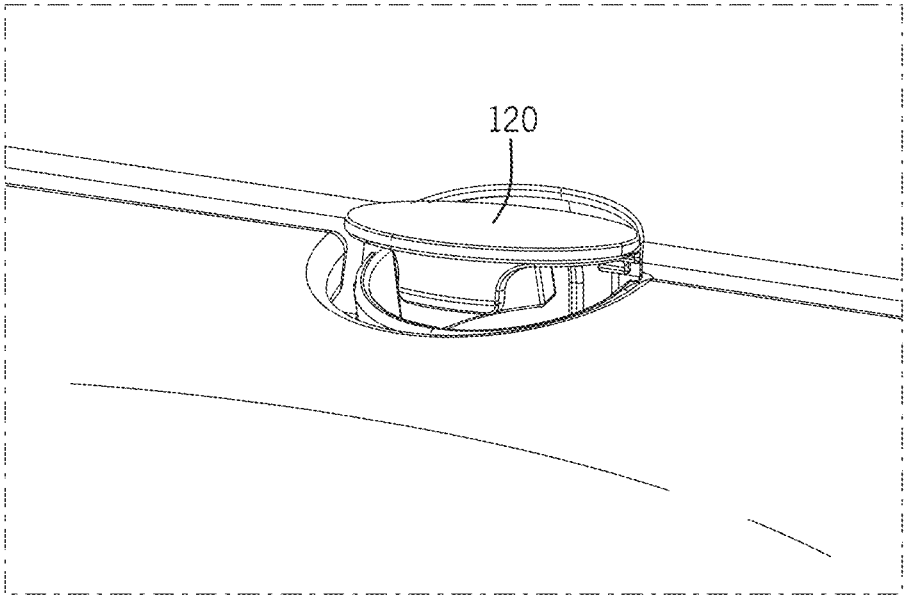

FIGS. 8A-8D illustrate example mounting plates for the electrical connection. The mounting plate 132 may include various wiring terminal 134*a-d* of different shapes and sizes. FIGS. 9A and 9B illustrate an example mechanical valve 120 for the sanitizing fluid.

Figure 10A:
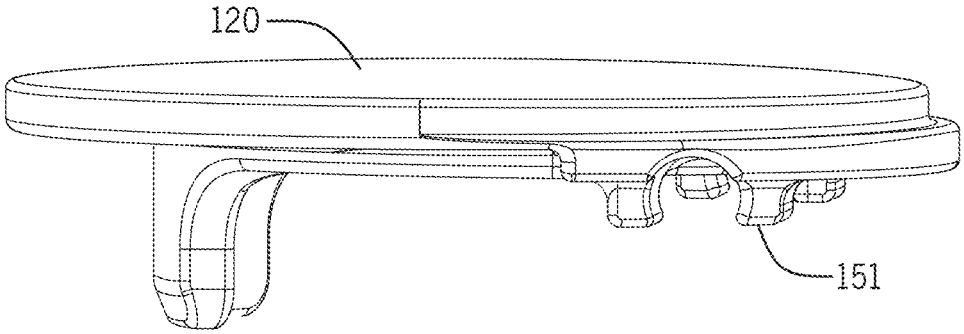
FIGS. 10A-C illustrate an example mechanical valve for the sanitizing fluid.
Figure 10B:
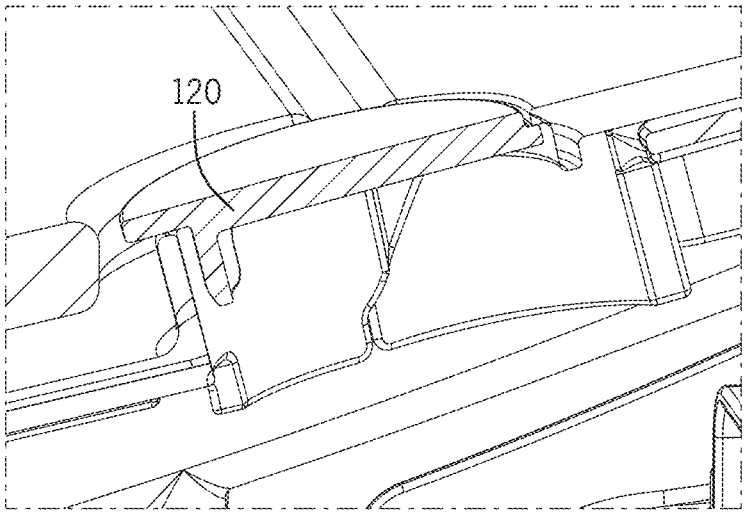
Figure 10C:
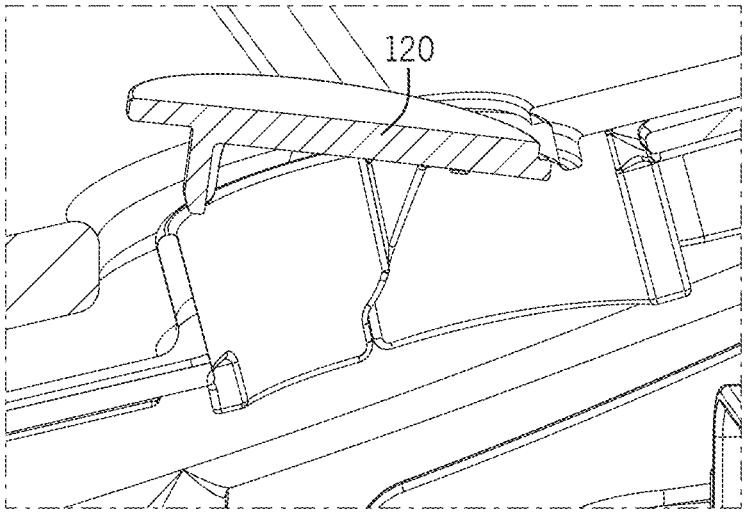

FIGS. 10A-C illustrate an example mechanical valve 120 for the sanitizing fluid illustrated in the closed position in FIG. 10B and the opened position in FIG. 10C. The valve 120 may include a valve hinge 151 that is offset from the center off the valve 120. The offset position of the valve hinge 151 may cause the valve 120 to open wide and place more weight of the valve 120 on the opened side of the valve 120 so that the force of gravity causes the valve 120 to close when the protrusion 121 of the lid 103 is not in contact with the valve 120.

Figure 11A:
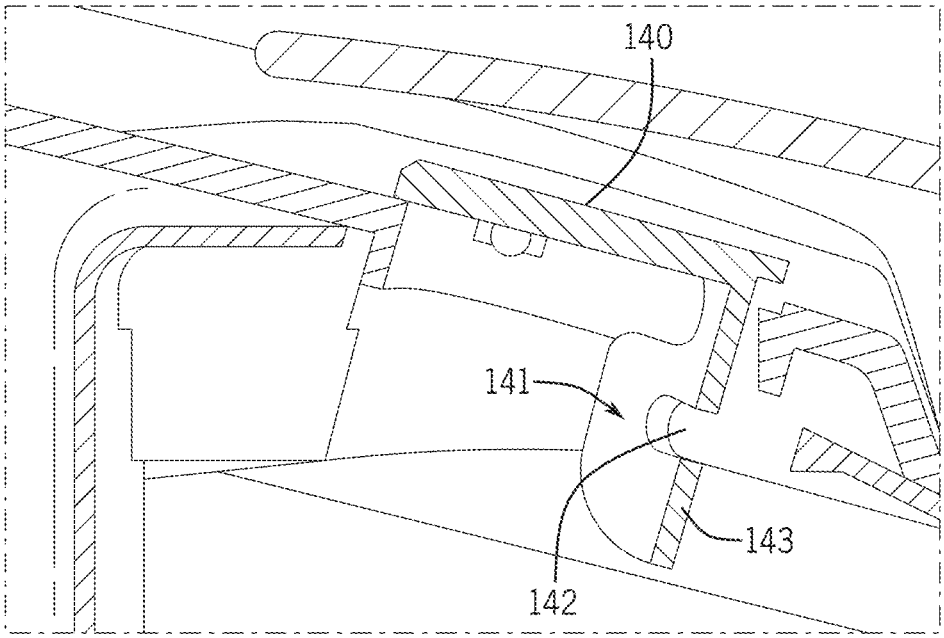
FIGS. 11A-B illustrate another example mechanical valve for the sanitizing fluid.
Figure 11B:
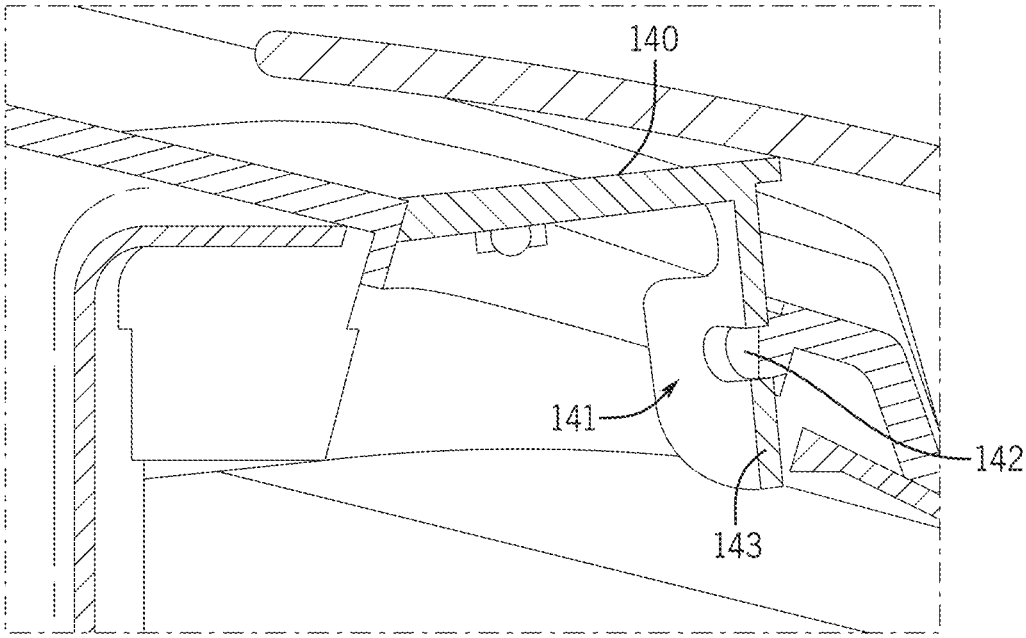
Figure 12:
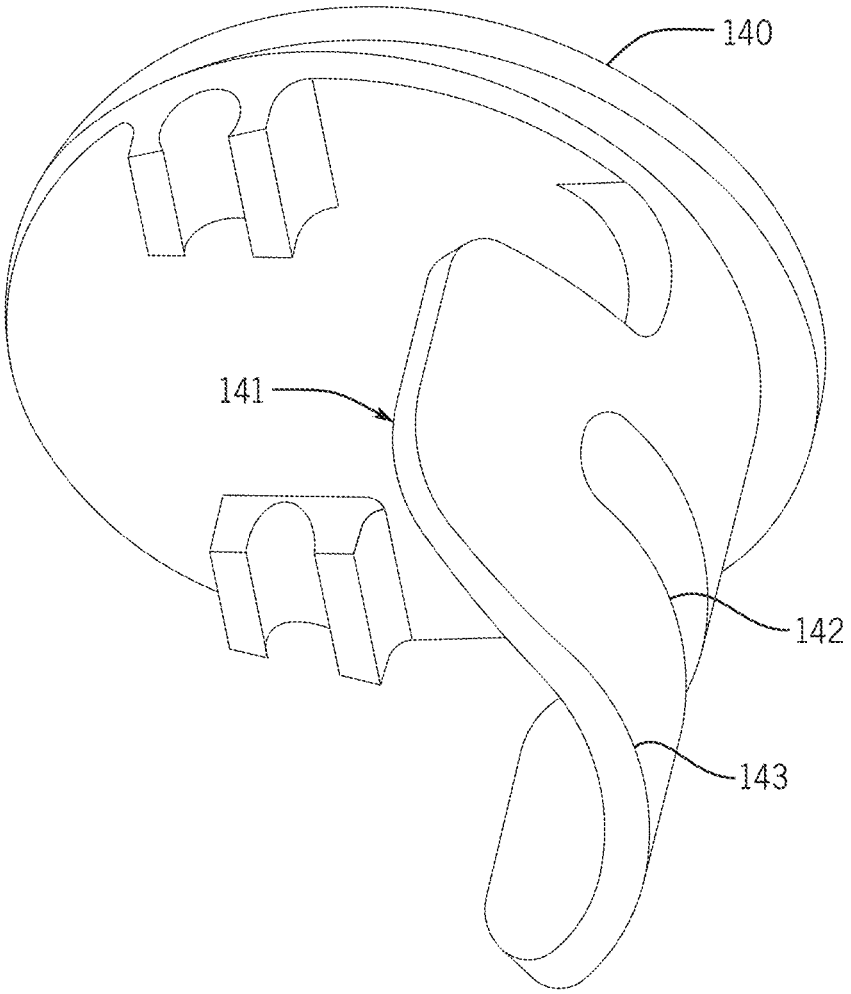
FIG. 12 illustrates another example mechanical valve for the sanitizing fluid.

FIGS. 11A-B illustrate another example mechanical valve 140 for the sanitizing fluid. The valve 140 may include a spout 141 configured to limit the quantity of the sanitizing fluid (e.g., $H_2O_2$ fog) flowing to the bowl and priority delivery above the ring when the lid is closed. The spout 141 may include a curved shield 143 that extends into the opening of the tank and limits the flow of the sanitizing fluid and an aperture 142 that provides a path for the sanitizing fluid out of the tank. FIG. 12 illustrates details of the example mechanical valve 140 for the sanitizing fluid. The spout 141 is an example flow limiter integrated with the valve 120 and is configured to meter the sanitizing material flowing into the toilet bowl.

The spout 141 may allow fog to flow into the bowl when the valve 120 is closed and when the valve 120 is open, the spout 141 reduces/stops flow into the bowl. One advantage is improved chemical usage and surface kill efficacy by increasing volume of fog onto top of ring or toilet seat 100. Fogged air above the bowl surface will help proactively kill/reduce contaminated aerosols that discharge from the bowl.

The following embodiments illustrate an example air flow and sanitizing fluid production for the toilet seat assembly. An air fan provides a flow of air into a misting head. At the misting head, the fluid is wicked or otherwise brought up to the misting head where the fog is produced. A lip in the tank defines the water level and provides a direction for the fog into the bowl.

Figure 13:
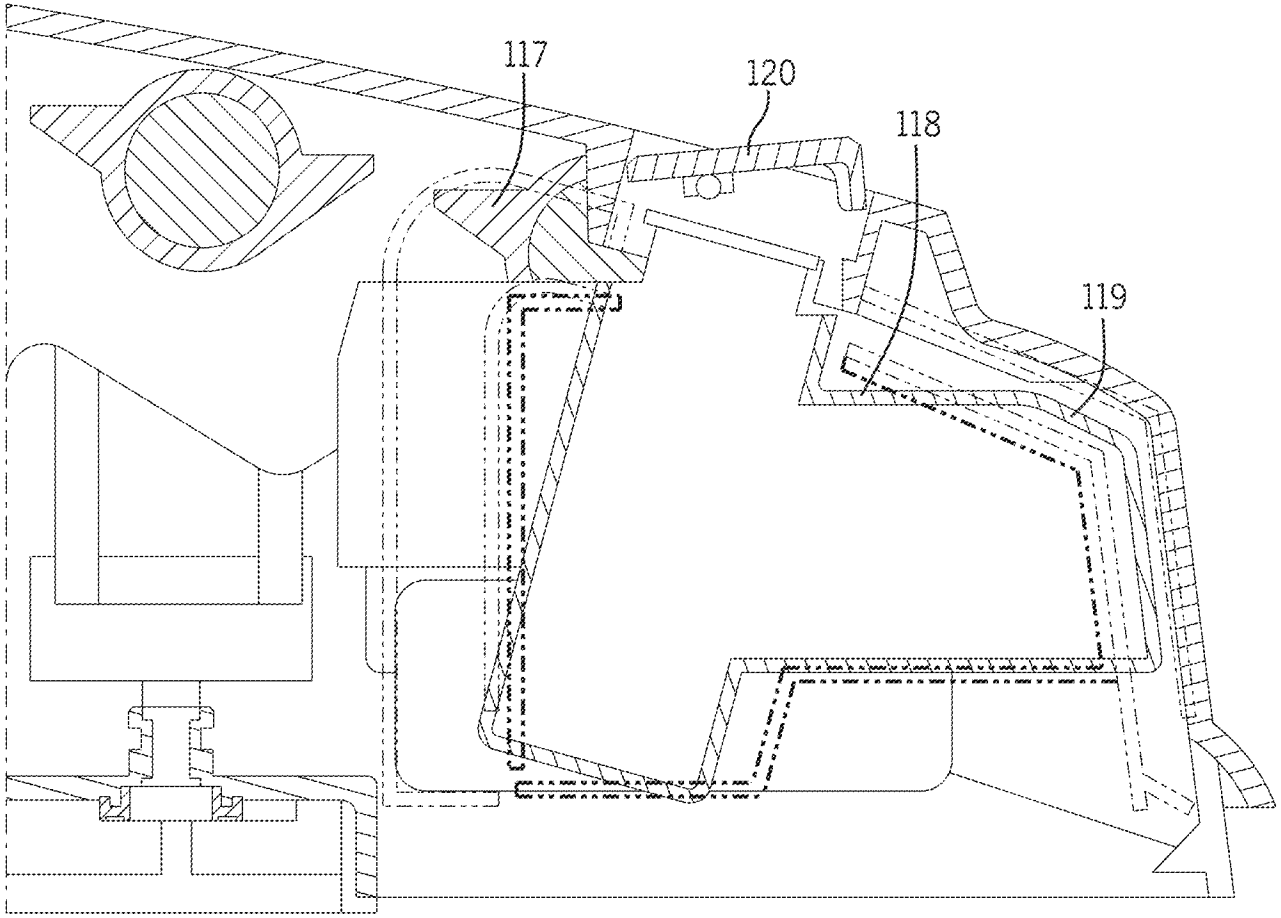
FIG. 13 illustrates an example air flow for the toilet seat assembly.

FIG. 13 illustrates an example air flow for the toilet seat assembly. The tank 118 may have various shapes and locations. In FIG. 13, the tank 118 defines an upstream air passage 117 providing a path to the tank and a downstream passage 119 providing a path away from the tank 118.

Figure 14A:
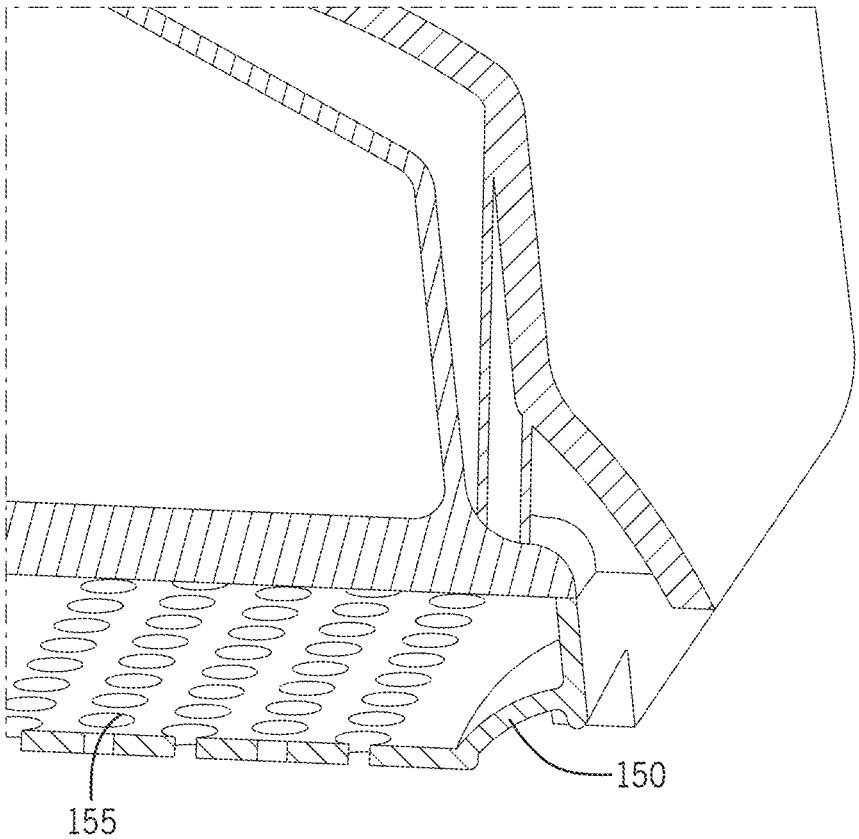
FIGS. 14A-B illustrates an example hinge plate for the toilet seat assembly.
Figure 14B:
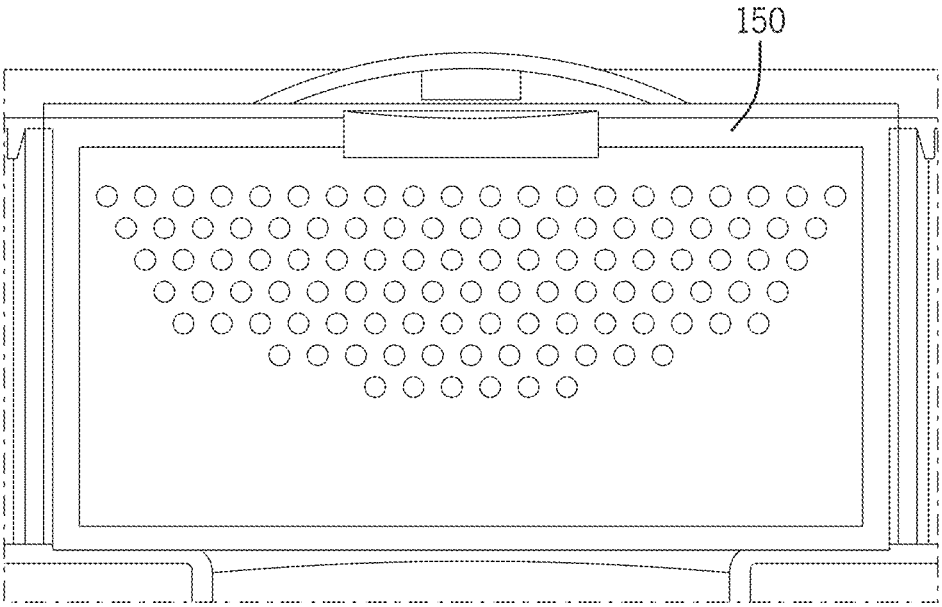

FIGS. 14A and 14B illustrate an example hinge plate 150 for the toilet seat assembly. The hinge plate 150 includes at least one orifice to deliver the sanitizing material to the toilet bowl. The hinge plate 150 may support a filter.

Figure 15A:
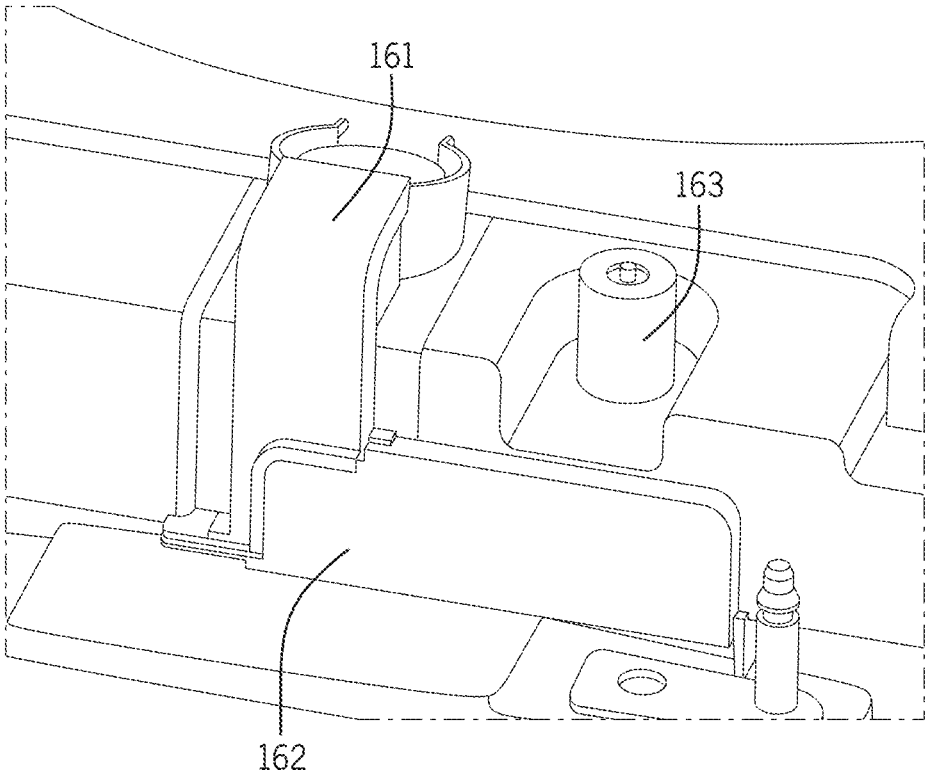
FIGS. 15A-B illustrates an example air duct and filter tray for the toilet seat assembly.
Figure 15B:
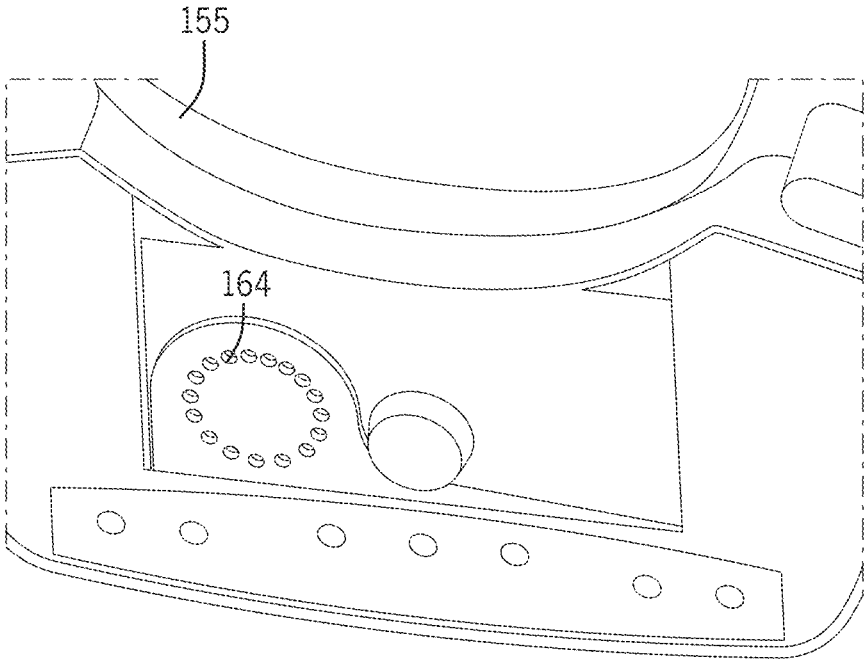

FIGS. 15A and 15B illustrate an example air ducts 161 and 162. A filter tray supports the filter 155 for the toilet seat assembly. A fan behind fan cover 164 provides air flow to draw the sanitizing material through the filter and hinge plate orifices. The fan assists the flow of the sanitizing fluid.

Figure 16:
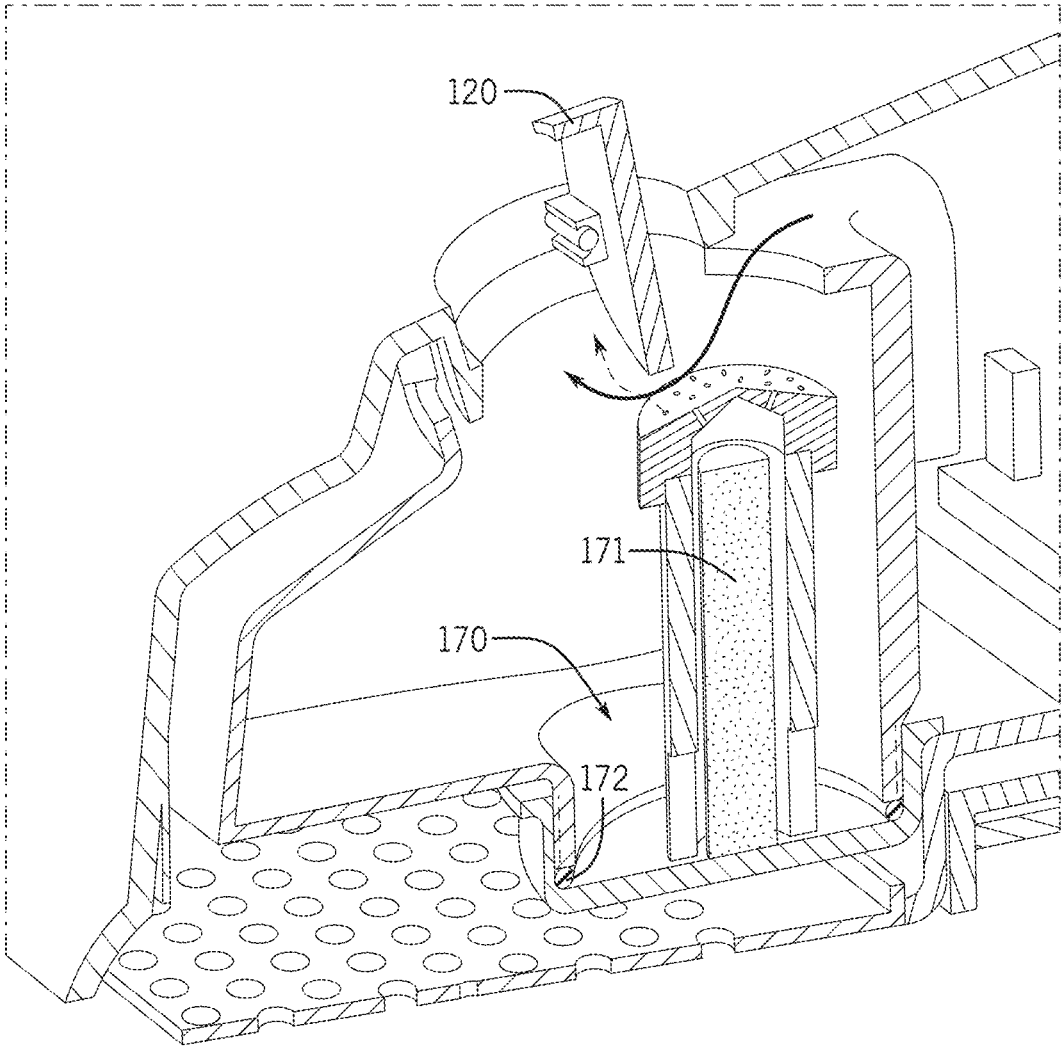
FIG. 16 illustrates an example drain cap for the toilet seat assembly.

FIG. 16 illustrates an example drain cap 170 for the toilet seat assembly. The drain cap 170 may be connected to the tank 118 to provide a service entry point and to drain the tank 118. The drain cap 170 may include a sacrificial plug connected to the drain cap 170 or the tank 118. The drain cap 170 may be coupled to a pipe member that supports the wick material. The term sacrificial may indicate that the drain cap 170 is sacrificed in order to disable or prevent unauthorized use of the toilet seat assembly. The drain cap 170 may be connected to the wick material.

A thread on drain cap 170 on the bottom of tank 118 assists the assembly of the fogging device into the tank 118 as well as provides service (replacement of module and/or cotton wick material).

The drain cap 170 may be designed to be inserted with threaded/plugged features that are made with materials that can withstand $H_2O_2$ but dissolve when exposed to unsafe or harsh cleaners. When dissolved, liquid will safely drain from the tank 118 and into the tray then toilet bowl. Thus, the drain cap 170 is a sacrificed when the toilet seat is used improperly so that unauthorized materials used in place of the sanitizing fluid are quickly removed from the toilet seat assembly.

When the sacrificial cap is dissolved or otherwise removed (e.g., for service), the toilet seat assembly may require return to the manufacturer or to a service personal to replace the drain cap 170. FIG. 16 also illustrates a wicking material 171 may be configured to connect to the drain cap to assist in the flow of the sanitizing material to the valve 120.

Figure 17:
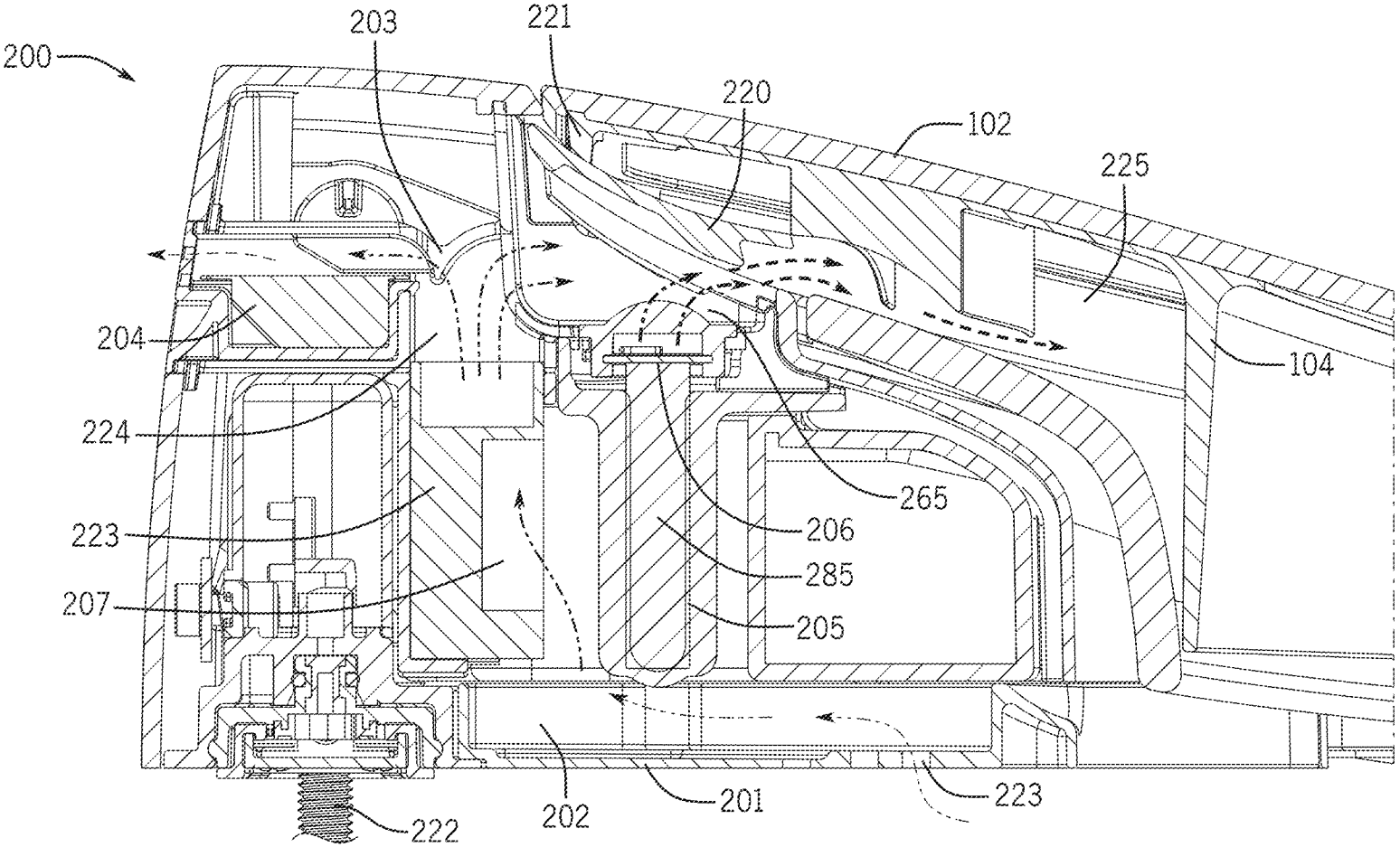
FIG. 17 illustrates an embodiment for the toilet seat assembly including a secondary air path.

FIG. 17 illustrates an example toilet seat assembly 200 including multiple airpaths as shown by arrows. The toilet seat assembly 200 includes a filter tray 201, a filter 202, a split 203, a scent module 204, a wick compartment 205, an atomizer 206, a fan 207, a cover 220, and a lid 101 having protrusion 221. The portions of the toilet seat assembly 200 other than the toilet seat 100 and lid 101 may be referred to as the hinge structure. Electrical components such as the fan 207, the atomizer 206, and, optionally, the scent module 204 may be electrically connected to a power supply and/or a controller. Additional, different, or fewer components may be included.

The toilet seat 100, which is not visible in FIG. 17, is rotatably connected to the toilet bowl via a hinge of the toilet seat assembly 200. The posts 133 connect the toilet seat assembly 200 to the toilet.

The air flow begins below the toilet seat assembly 200. One or more vents 227 may be on the bottom of the hinge structure or on the sides of the toilet seat assembly 200. The fan 207 is configured to direct the flow of air into the hinge structure through the vents 227. The first chamber in the toilet seat assembly 200 is a filter chamber 202. The filter chamber 202 may include a filter to remove particles from the are flow. The filter chamber 202 may include a filter tray that slides out with respect to the hinge structure. The filter tray may be removed for the installation of a filter (filter fabric) in the filter tray. In addition or in the alternative, the filter tray may be formed of an electrostatically charged material. An example material is polypropylene. The charge may electrostatically collect particles from the air flow.

In some examples, the air flow subsequently flows through the fan 207. In other examples the air flows adjacent to the fan 207. The space around the fan is the fan compartment 223.

After the fan compartment 223, the air flow proceeds to a divergent chamber 224. In the divergent chamber 224 a split device 203 divides the air flow into two flows. One flow (to the left in FIG. 17) proceeds to a scent module 204 and the other flow (to the right in FIG. 17) proceeds through an opened cover 220.

Figure 28:
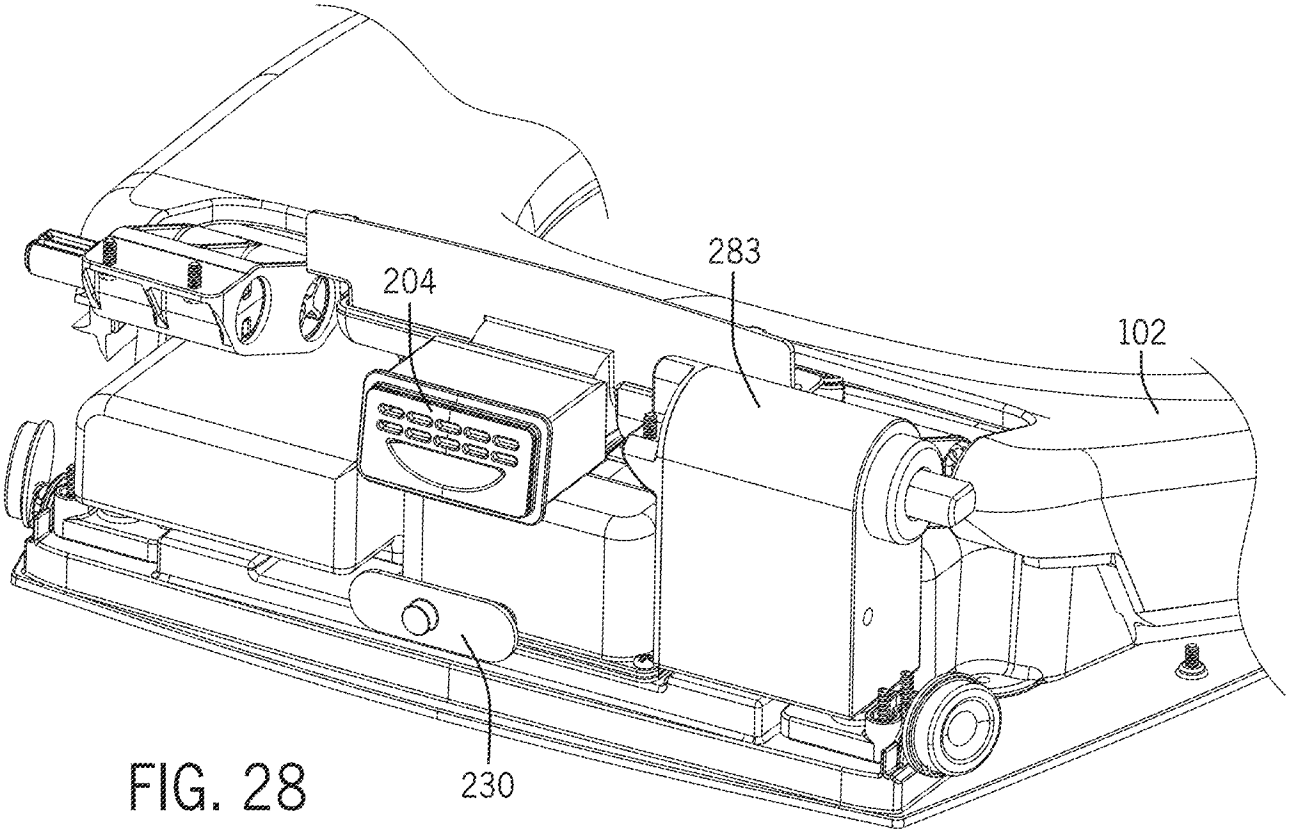
FIG. 28 illustrates a rear view of the toilet seat assembly include a sliding switch.

The scent module 204 may include a tray that is removable from the toilet seat assembly 200 (shown in FIG. 28). The scent module 204 may include a latch or lip that flexes to couple to a tab in the toilet seat assembly 200. The scent module 204 may include a replacement cartridge with a predetermined scent. The scent emitted from the scent module 204 may cover foul odors from the toilet. The scent may smell clean to the user. The material of the scent module 204 may evaporate into the air. The material of the scent module 204 may include an oil or other liquid.

The split device 203 is used to split the first flow (to the left in FIG. 17) and the second flow (to the right in FIG. 17) to separate the scent from the hydrogen peroxide. This is because if the hydrogen peroxide and the scent shared the same space, the hydrogen peroxide could breakdown the scent.

The second flow proceeds to the sanitizing chamber 225 where the hydrogen peroxide is added to the flow. A wick compartment 205 in the hinge structure includes a wick material. The wick material 285 may be formed of cotton or a fabric. The wick absorbs the sanitizing fluid and through capillary action brings the sanitizing fluid up to the atomizer 206.

The wick compartment 205 and the atomizer 206 may be coupled together by a misting cap 265. The misting cap 265 may be formed of rubber. The atomizer 206 may be include a stainless steel frame and a piezoelectric element. The wick compartment 205 houses the sanitizing fluid. In some instances the wick includes all of the sanitizing fluid. In some instances, there is some pooling of fluid in the wick compartment 205 adjacent to the wick compartment 205. The misting cap 265 may apply a pressure to the wick that holds the wick tight in the misting compartment 205. The misting cap 265 may be twisted to lock the misting cap 265 to the wick compartment 205.

The atomizer 206 turns the sanitizing fluid to a mist or fine spray of particles. The mist is sprayed into the sanitizing chamber 225 into the flow of air. The flow of air carries the sanitizing particles to the toilet seat 100 where it disinfects the surfaces of the toilet seat 102. The atomizer 206 configured to spray fine particles of the sanitizing fluid into the flow of air from the fan 207.

It should be noted that the atomizer 206 could also operate to fill the sanitizing chamber 225 with the sanitizing particles even if the fan 207 was not included. However, the movement of the air by the fan 207 plays a significant role in the distribution of the sanitizing particles. In addition the fan 207 may be turned on and off in a cycle with the atomizer 206. The fan 207 may be operated after the atomizer 206 is turned off to cause dry air (i.e., air without the sanitizing particles) to aid in the evaporation in the sanitizing chamber 225. Increased evaporation in the sanitizing chamber 225 causes the toilet seat 100 to try faster. Further, as water evaporates, the concentration of the hydrogen peroxide increases, and the efficacy of the sanitizing fluid may be increased.

Figure 18:
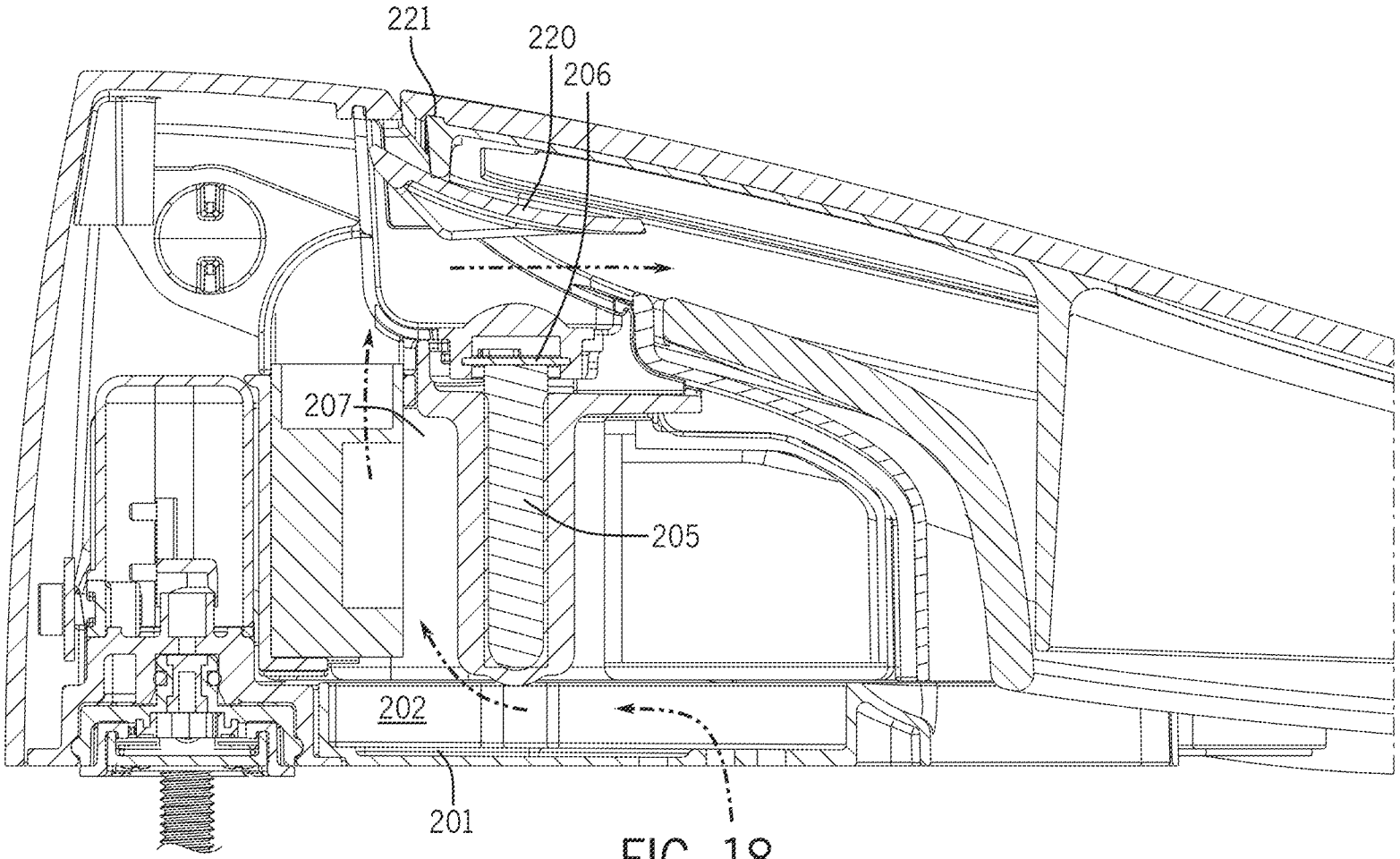
FIG. 18 illustrates an embodiment for the toilet seat assembly including a vertical fan.
Figure 19:
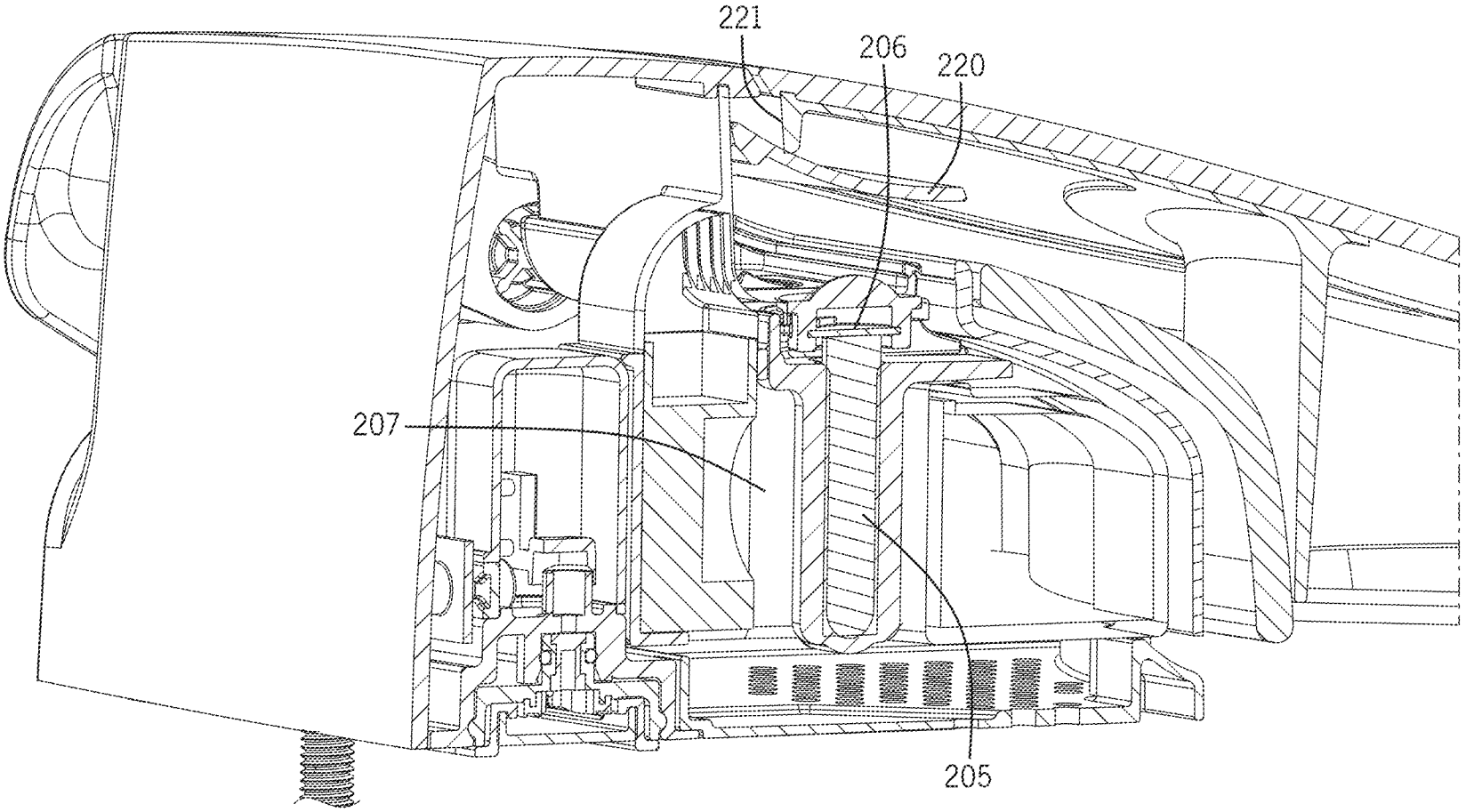
FIG. 19 illustrates a rotated view of the embodiment of FIG. 18.

FIGS. 18 and 19 illustrate an embodiment for the toilet seat assembly 200 without the scent module 204 and the split device 203. In this example, substantially all of the flow of forced air through the toilet seat assembly 200. That is, the flow of air passes through the inlet vents past the filter 202 and directly to the top of the atomizer 206 where the sanitizing particle mist is added to the flow and then out to the toilet seat 100 through the opening of the cover 222. The fan 2007 may be arranged vertically or in another position in this embodiment.

Figure 20A:
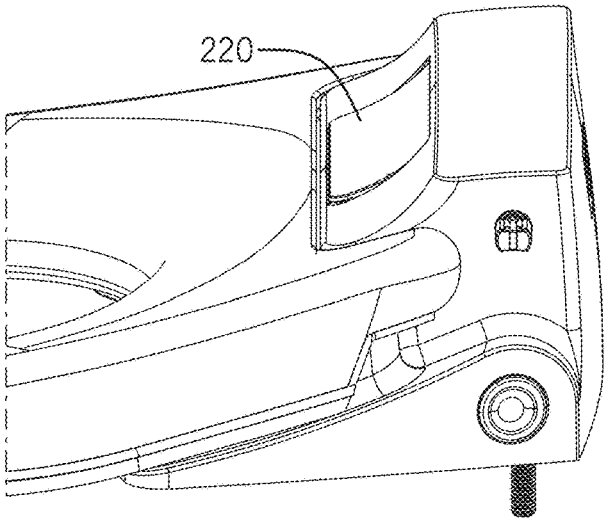
FIGS. 20A, 20B, and 20C illustrate an example removable sanitizer cover.
Figure 20B:
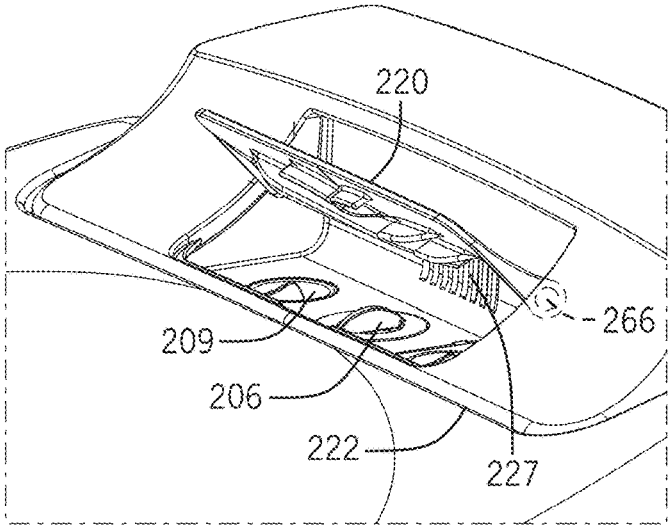
Figure 20C:
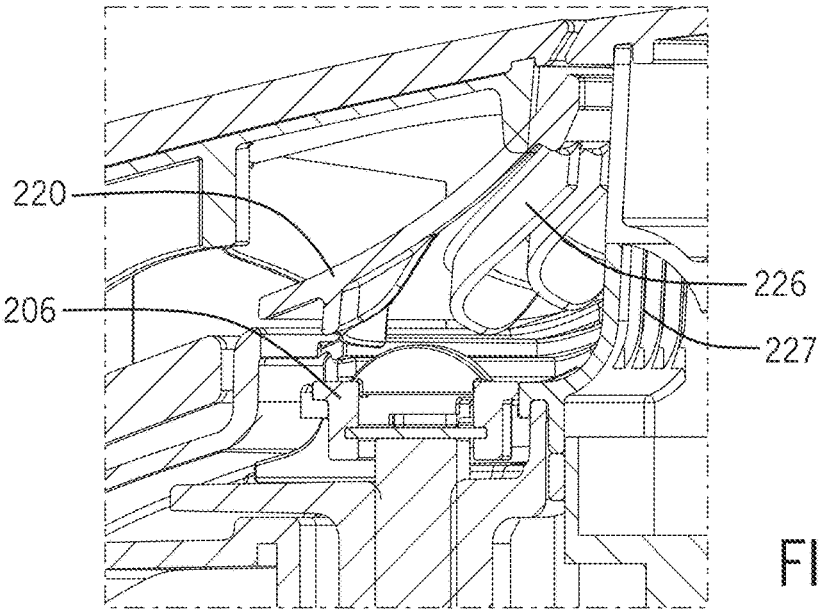

FIGS. 20A, 20B and 20C illustrate an example removable sanitizer cover 222. The cover is configured to pivot about an axis with the protrusion 221 applies a downward force on the cover 222. The cover or hinge plate is configured to open under a force from the protrusion 221 to deliver the sanitizing material to the toilet bowl when the protrusion 221 is pressed against the cover 222 at a predetermined position to release the sanitizing material into the toilet bowl.

The pivoting with respect to the toilet seat assembly 200 may be made possible using a boss 266 that pivots in a recess or dimple in the toilet seat assembly 200. The boss 266 may be tiered to encourage a uniform gap between both side of the cover 222 with respect to the toilet seat assembly 200. The boss 266 or the mating recess or dimple may include two layers the hinge plate to both fasten and remove the hinge plate or cover 222 to the toilet seat assembly 200 through rotation. The cover 222 or hinge plate is removable due to a force exerted by the boss 266 and/or dimple to the toilet seat assembly when the cover 222 is rotated away from the toilet seat assembly 200.

For example, the cover 222 may be removable through an overrotation of the cover 222. The term overrotation may be an amount of rotation of the cover 222 with respect to the toilet seat assembly 200 that exceeds that which can be applied by the protrusion 221. The overrotation may be greater than 90 degrees. When the cover 222 is overrotated the boss 266 applies a force against the toilet seat assembly 200 to push the cover 222 away from the hinge section and pop the cover 222 out of engagement. In this way, the user may remove the cover 222 to perform maintenance on the toilet seat assembly 200. Examples of maintenance include filing the sanitizing fluid, replacing the wick, removing clocks from the wick or the wick compartment 205, or other cleaning of the wick or the wick compartment 205.

Under the cover 220, the atomizer 206 and vents 227 from the fan compartment are visible. A fill cap 209 may be adjacent to the atomizer. The fill cap 209 may be rotated or removed so that the user can add sanitizing fluid to the wick compartment 205 or the tank 210.

As shown in FIG. 20C, the cover 222 may also include at least one fin 226 configured to direct the flow of air including the fine particles of the sanitizing fluid toward a surface of the toilet seat 202.

Figure 21:
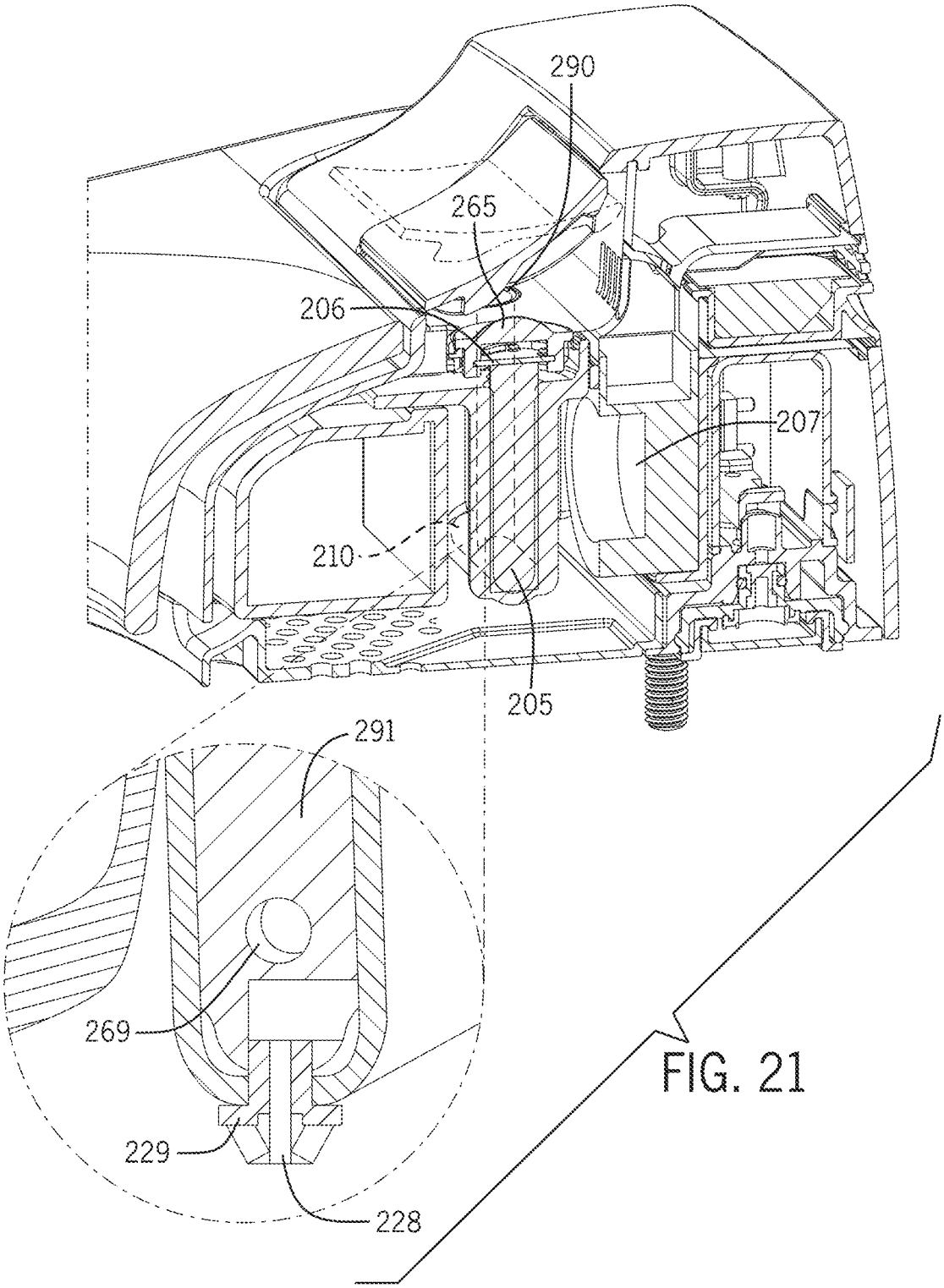
FIG. 21 illustrates an example sanitizer tank.

FIG. 21 illustrates an example sanitizer tank 210. The tank 210 may be oriented a different angle than the wick compartment 205. The tank 210 stores sanitizing fluid and is fluidly coupled to the wick compartment 205. The tank 210 may be a cylindrical prism. The tank 210 may be flexible (e.g., a bag). The wick and/or the wick compartment 205 may mate with the tank 210.

A dial 290 may be adjacent to the wick compartment 205. The dial 290 may be coupled to a rotatable valve 291 with a through hole or recess 269. When the dial 290 is rotated the rotatable valve 291 opens and closes. In one example, the rotatable valve 291 connects the tank 210 and the wick compartment 205 in a first position and disconnects the tank 210 and the wick compartment 205 in a second position. Various configurations are possible for the connection between the tank 210 and the wick compartment 205. In one example, a metering device may be between the tank 210 and the wick compartment 205 to allow only predetermined amount of sanitizing fluid into the wick compartment. Because the tank 210 is generally more closed or water tight than the wick compartment, a majority of the hydrogen peroxide may be kept in the tank 210.

In one example, the connection between the tank 210 and the wick compartment 205 includes a one way valve. The one way valve prevents backflow of sanitizing fluid from the wick compartment 205 to the tank 210. If water splashes into the wick compartment 205 or if urine enters the wick compartment 205, it cannot flow back to contaminate the tank 210.

In one example, the connection between the tank 210 and the wick compartment 205 varies according to a rotation of the wick. The wick compartment 205 may include an opening 269 that aligns with an opening of the tank 210 when the wick is rotated in an open position. Otherwise, in a close position, the wick compartment 205 is rotate so that the openings are not aligned. The wick may also be released by rotation, which allows an empty wick compartment 205 to be cleaned.

The wick compartment 205 may also be drained through rotation. For example the bottom of the wick compartment 205 may be fitted with a valve 229 including a through hole 228 that is opened as the wick is rotated.

In addition to draining the wick compartment 205, sometimes there are liquids in the toilet seat assembly 200 because of spillage. When the user adds sanitizing fluid to the toilet seat assembly 200, the fluid may spill into a chamber. The user (e.g., when urinating) may spill urine into the toilet seat assembly 200. For these instances, the toilet seat assembly 200 is designed to drain away the spilled liquid into the toilet.

Figure 22:
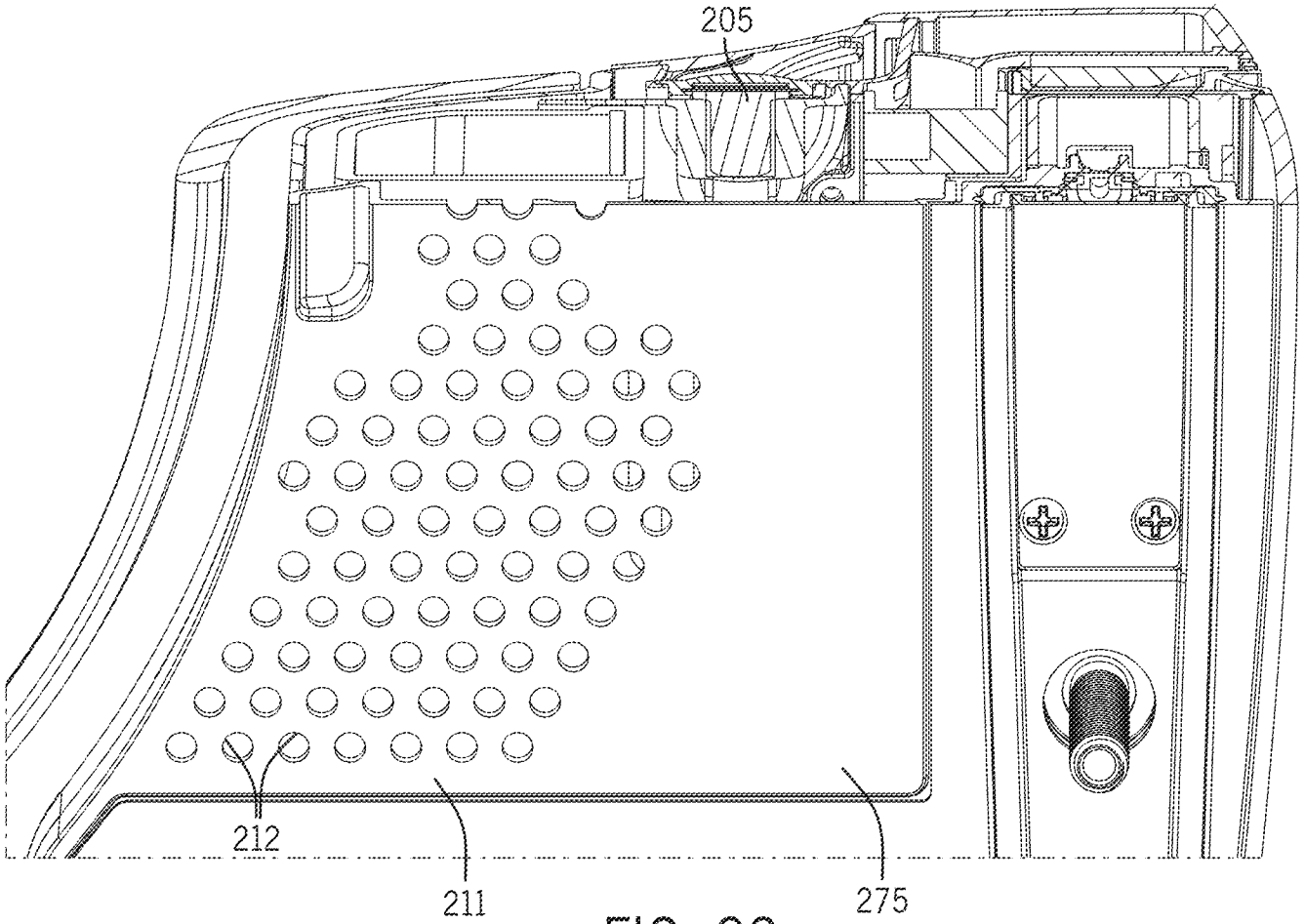
FIG. 22 illustrates an example drain plate.
Figure 23:
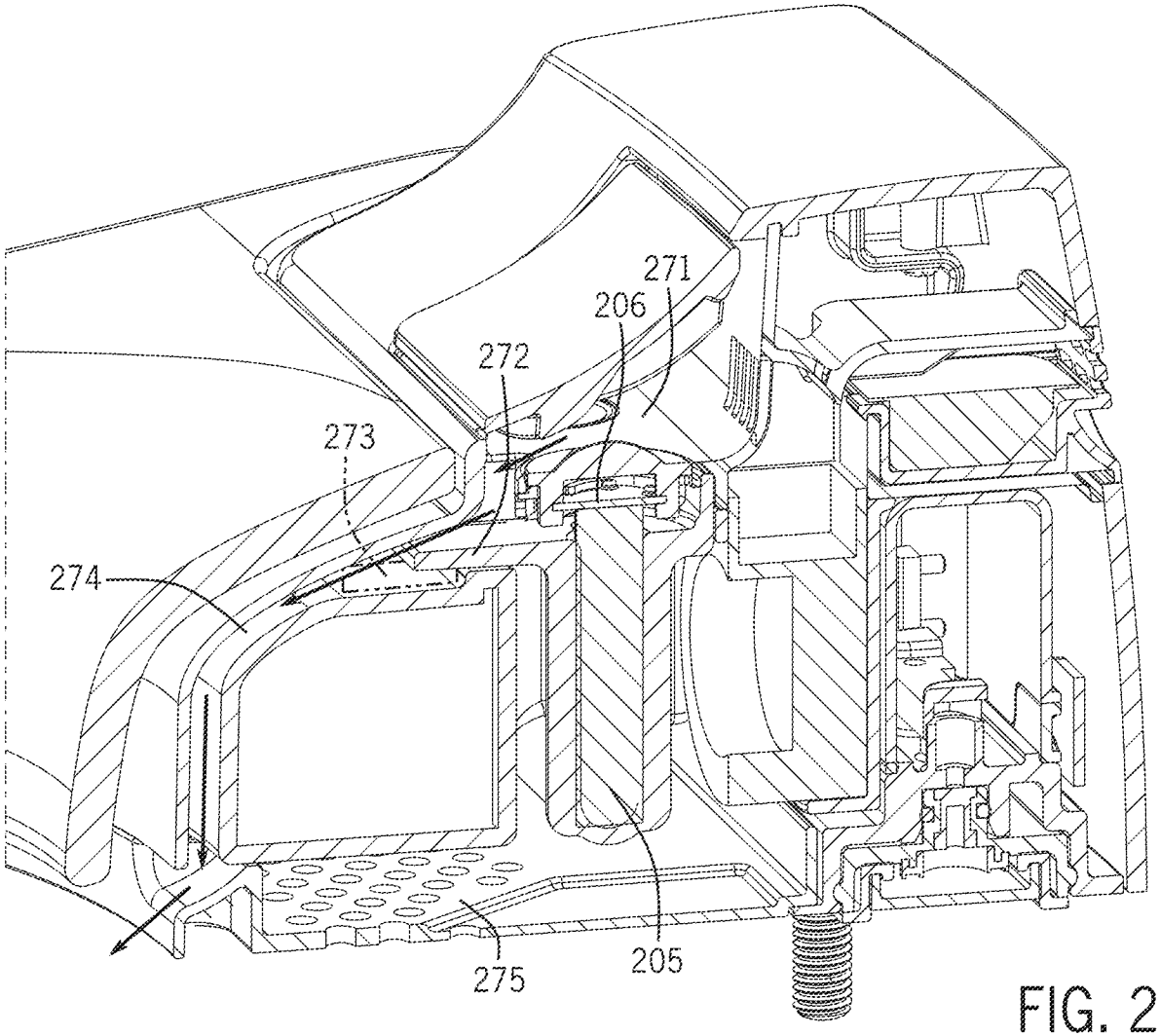
FIG. 23 illustrates an example spill path through the toilet seat assembly.

FIG. 22 illustrates an example drain plate 275. The drain plate 275 may include a solid portion 211 and opening 212. FIG. 23 illustrates an example spill path or overflow path through the toilet seat assembly. The overflow path includes multiple surfaces sloped down toward the toilet bowl.

The spill path may cross multiple surfaces. The spill path may include a floor 271 of the sanitizing compartment, a ledge 272 for the support of the wick compartment 205, a top surface 273 of a side compartment, and a vertical passage 274.

The drain plate 275 may be sloped down toward the toilet bowl (e.g., in the direction of gravity) so that any spills move away from the hinge structure, which includes water sensitive components such as the controller, power supply, and various wiring, and toward the toilet bowl.

Figure 24A:
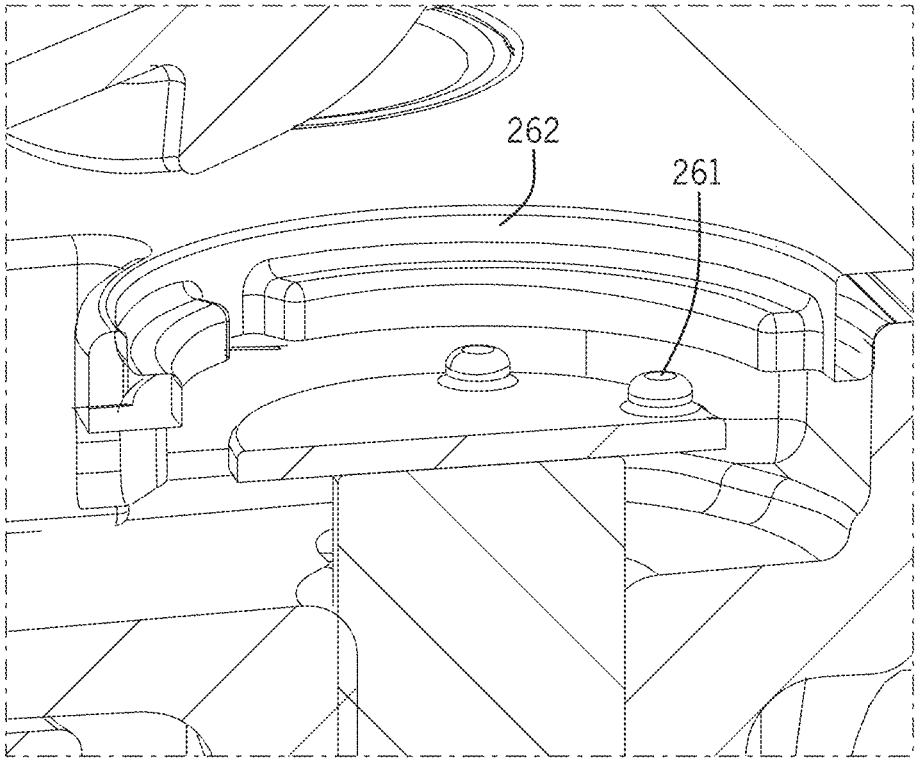
FIGS. 24A and 24B illustrates an example lock for the wick.
Figure 24B:
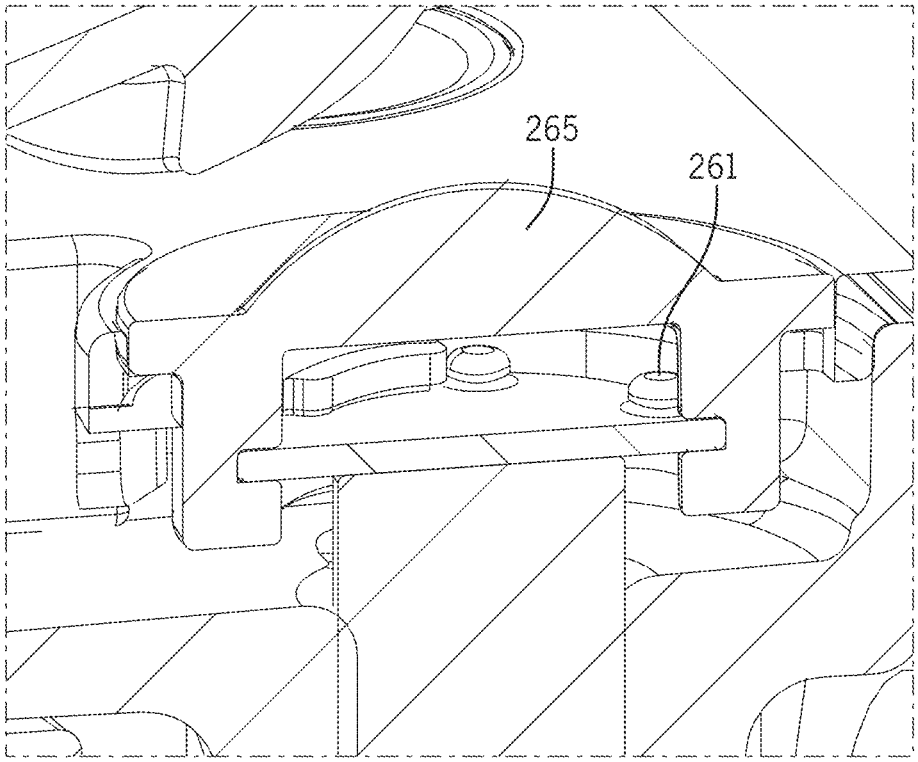

FIGS. 24A and 24B illustrates an example lock for the wick. The misting cap 265 may attach to the wick compartment 205 at a ridge 262 via a connector and attached to the atomizer 206 via the connector. As the misting cap 265 is rotated along the ridge 262, various locking tabs 261 may engage or disengage the misting cap 265.

When one of the tabs, or combination of tabs, engages the misting cap 265 and is locked with the wick compartment 205 and the housing of the atomizer 206 in a first position. The first position may be a relative rotational position between the misting cap 265 and the wick compartment 209. When one of the tabs, or combination of tabs, engages the misting cap 265 at a second position, the wick compartment 205 may be removed. The second position may be a relative rotational position between the misting cap 265 and the wick compartment 205.

Figure 25A:
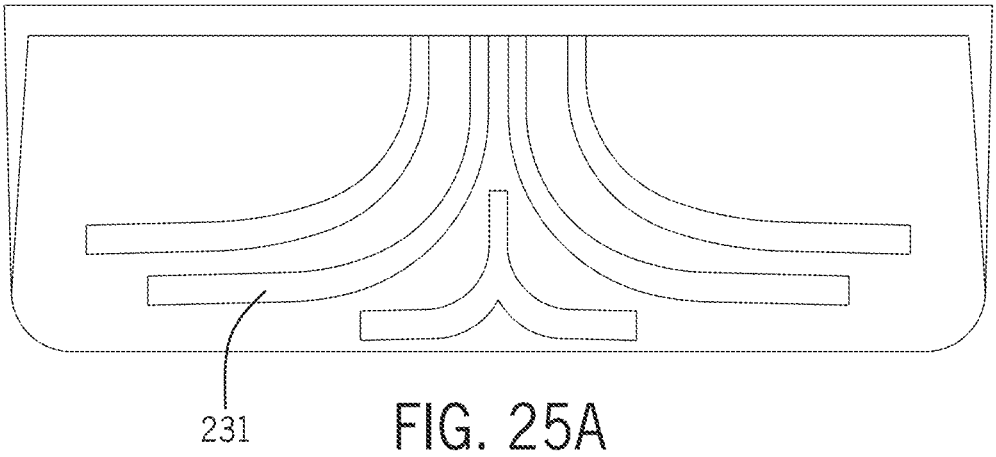
FIGS. 25A and 25B illustrates example fins for the flow of the sanitizing air flow.
Figure 25B:
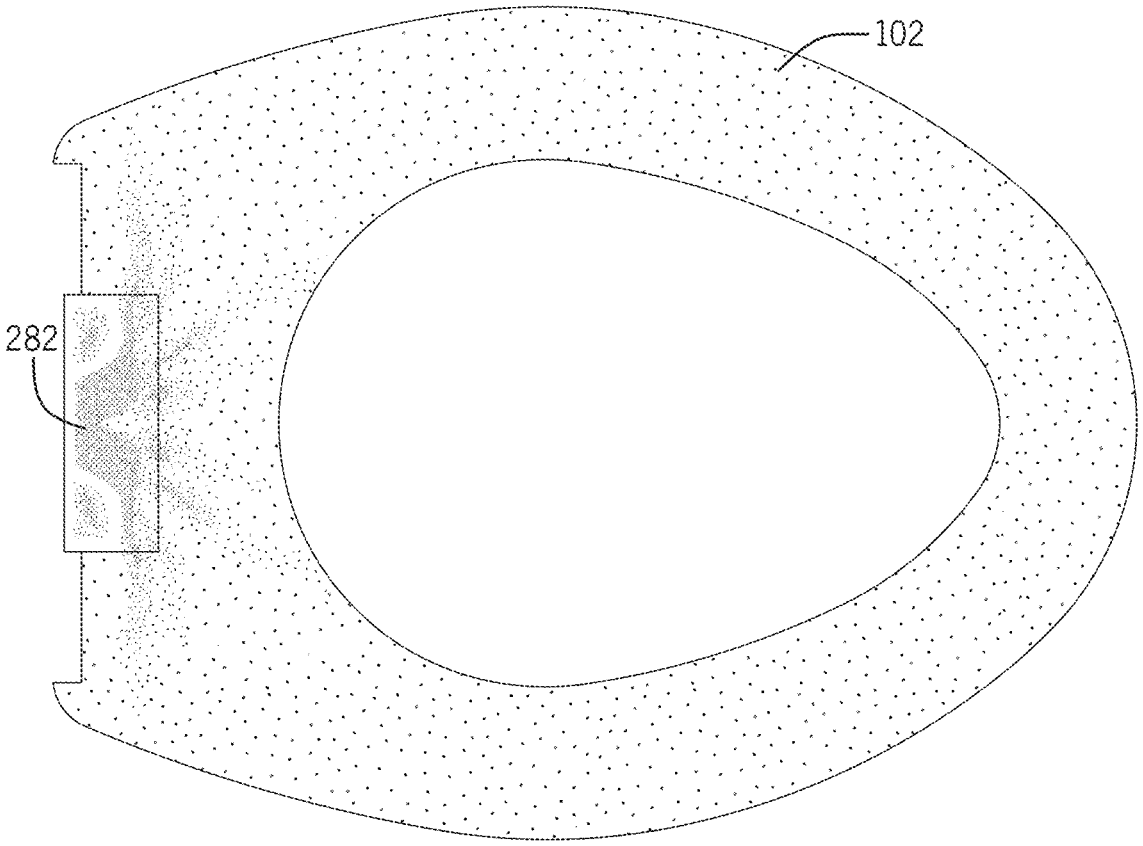

FIGS. 25A and 25B illustrates example fins 231 for the flow of the sanitizing air flow. As the flow of air in the hinge structure leaves the sanitizing compartment, it is released into the seat compartment, which overlaps the toilet seat 100. The air is most effective as it travels around the toilet seat 100. The fins 231 provide a guided air path around the toilet seat. A path of the air flow is illustrated by pattern 282.

Figure 26:
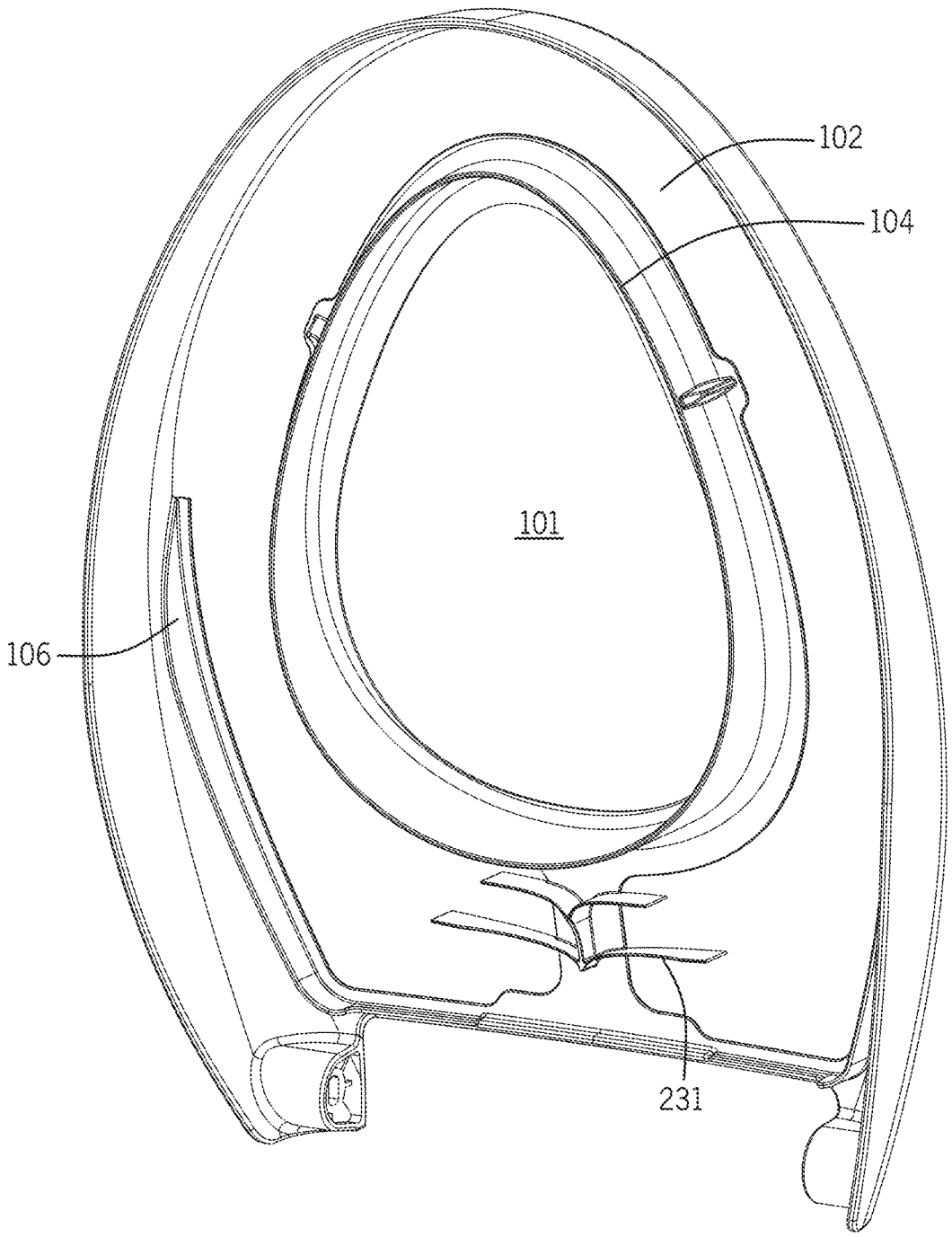
FIG. 26 illustrates an example placement of the fins on the toilet seat.

FIG. 26 illustrates an example placement of the fin 231 on the toilet seat 100. The fins 231 may be curved away from the vents 227 and then horizontal along the rear of the toilet seat 100.

Figure 27:
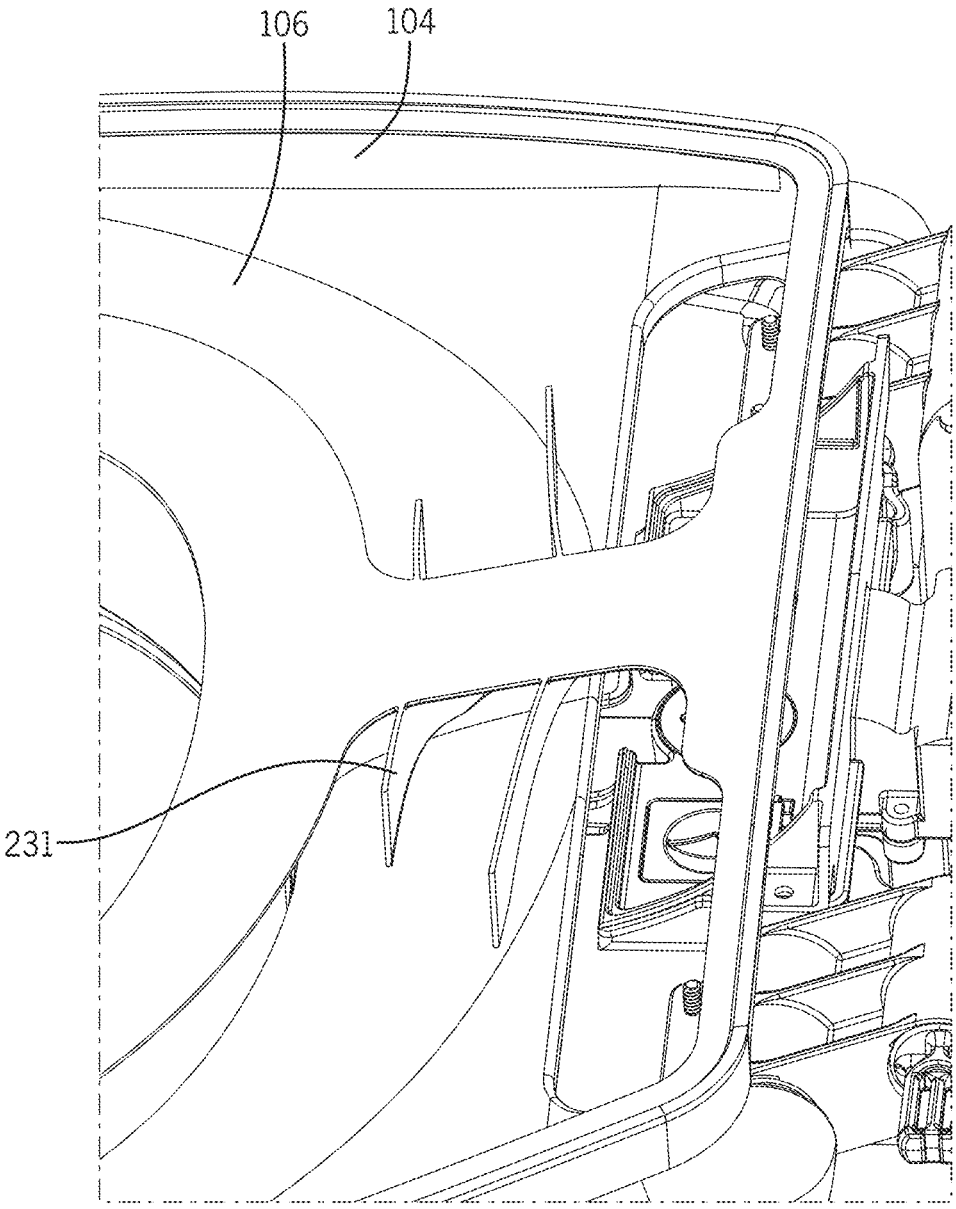
FIG. 27 illustrates another view of the fins integrated with one or more seals.

FIG. 27 illustrates another view of the fin 231 integrated with one or more seals 104 and 106. That is, an integrated component of a single construction may include the fin 231, the seal 104, and the seal 106.

Figure 29:
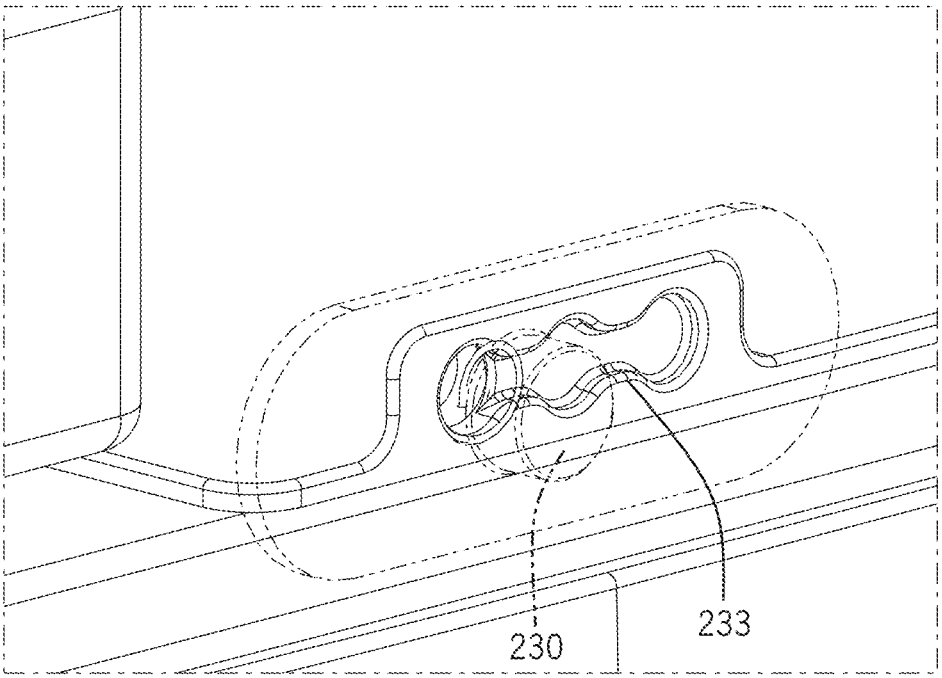
FIG. 29 illustrates example positions of the sliding switch.

FIG. 28 illustrates a rear view of the toilet seat assembly include a sliding switch 230. The sliding switch 230 may be in electrical connection with the controller. The sliding switch 230 may operate various functions of the toilet seat assembly. FIG. 29 illustrates example positions 232 of the sliding switch 230. A detent in a flexible housing (e.g., rubberized gasket) may allow the switch 230 move between the positions 232 by flexing the flexible housing but rest easily in the grooves of the flexible housing. The sliding switch 230 may turn the toilet seat assembly 200 on and off. The sliding switch 230 may be spring loaded in order to aid motion across the detents in the flexible housing. Additional, different, or fewer components may be included.

The sliding switch 230 may be an example slider configured to select a mode for the toilet seat assembly. The mode may control how the toilet seat assembly 200 opens the ring or seat 100 and the lid 101 using a motor 283. There may be a presence only opening mode for the toilet seat assembly 200, in which the controller sends instructions to operate the motor 283 to open the lid 101 only when presence of a user is detected. There may be an automatic opening mode for the toilet seat assembly 200, in which the controller sends instructions to operate the motor 283 after the cleaning cycle has ended. The controller may determine that the cleaning cycle has ended based on a timer reaching a set elapsed time. The controller may determine that the cleaning cycle has ended based on data from a moisture sensor in the seat compartment.

There may be a maintenance mode where the controller checks the operation of the atomizer 206, fan 207, or another component. In the maintenance mode, the controller may check the level of the sanitizing fluid.

In one example, the motor 283 is omitted and slow close dampers are used. In this case, the sliding switch 230 may only turn on and off the sanitizing system. It is also possible to omit the atomizer 206 such that the sanitizing fluid evaporates direction into the air. It is also possible to omit the fan 207. Air flow may be achieved through the suction resulting from flushing the toilet with the lid 101 closed.

Various power supplies are possible. The toilet seat assembly 200 may include a cord for AC power from an outlet. The toilet seat assembly 200 may include an alternating current to direct current (ADC) converter. Power is provided from the power supply to the atomizer 206, fan 207, motor 283, display, and other components. In some examples, a battery may be used. The battery may be removable and chargeable.

The display may include indicators for the operation of the toilet seat assembly 200, which is discussed in more detail below.

Figure 30A:
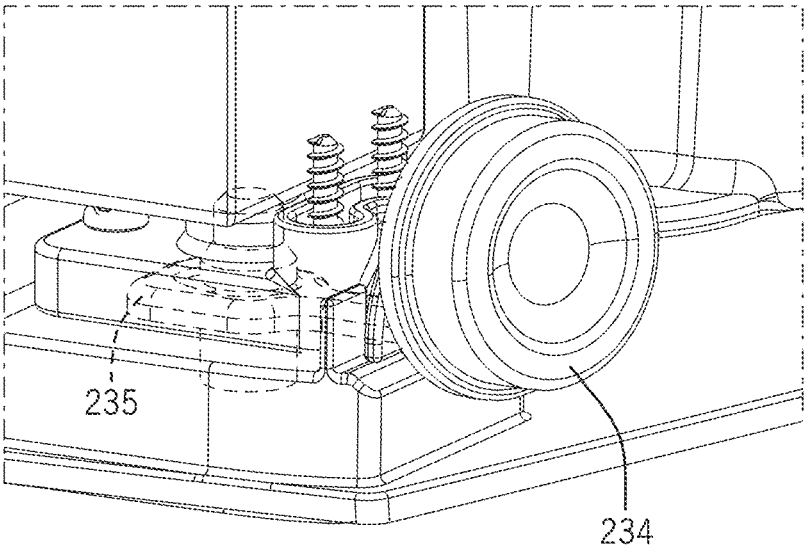
FIGS. 30A and 30B illustrate an example quick release hinge for the toilet seat assembly.
Figure 30B:
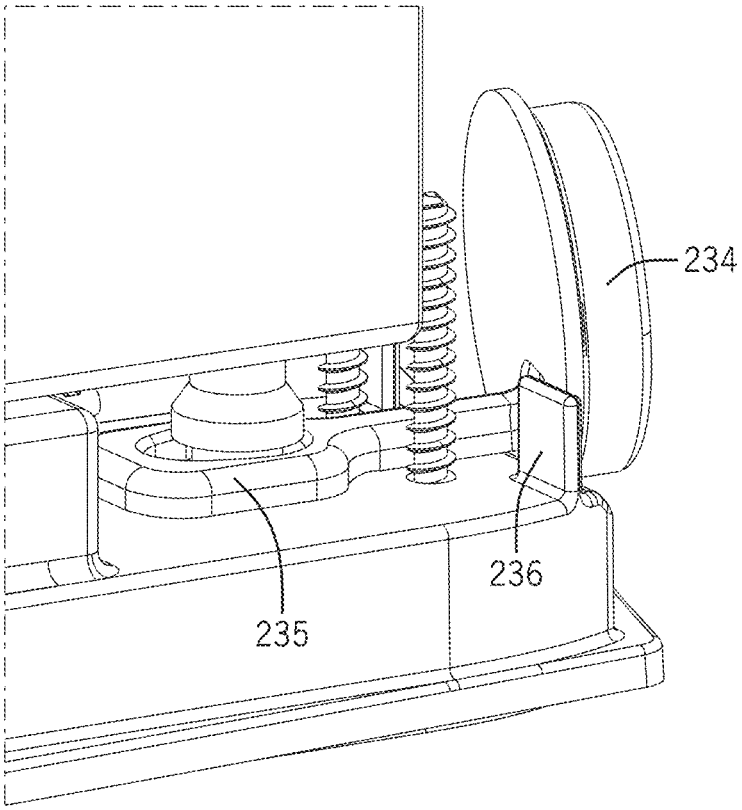

FIGS. 30A and 30B illustrate an example quick release hinge 234 for the toilet seat assembly 200. The releasable hinge 234 is mounted using a frame 235 and biased outward by spring 236 (biasing member). The releasable hinge 234 is operable in a locked position, for example, pushed out by the spring 236. In the locked position, the toilet seat assembly 200 cannot be removed from the toilet. When the user presses in on the releasable hinge 234, which may require one or both hinges, the hinge 234 is moved from the locked position to the unlocked position against the force of the spring 235. In the unlocked position, the toilet seat assembly 200 can be removed from the toilet.

In some examples, the releasable hinge 234 is operable in a further lock position or override position. This position may lock the releasable hinge 234, regardless of whether the releasable hinge 234 is pushed in against the biasing member 236. The override lock may be reverse only using a special tool or key.

Figure 31:
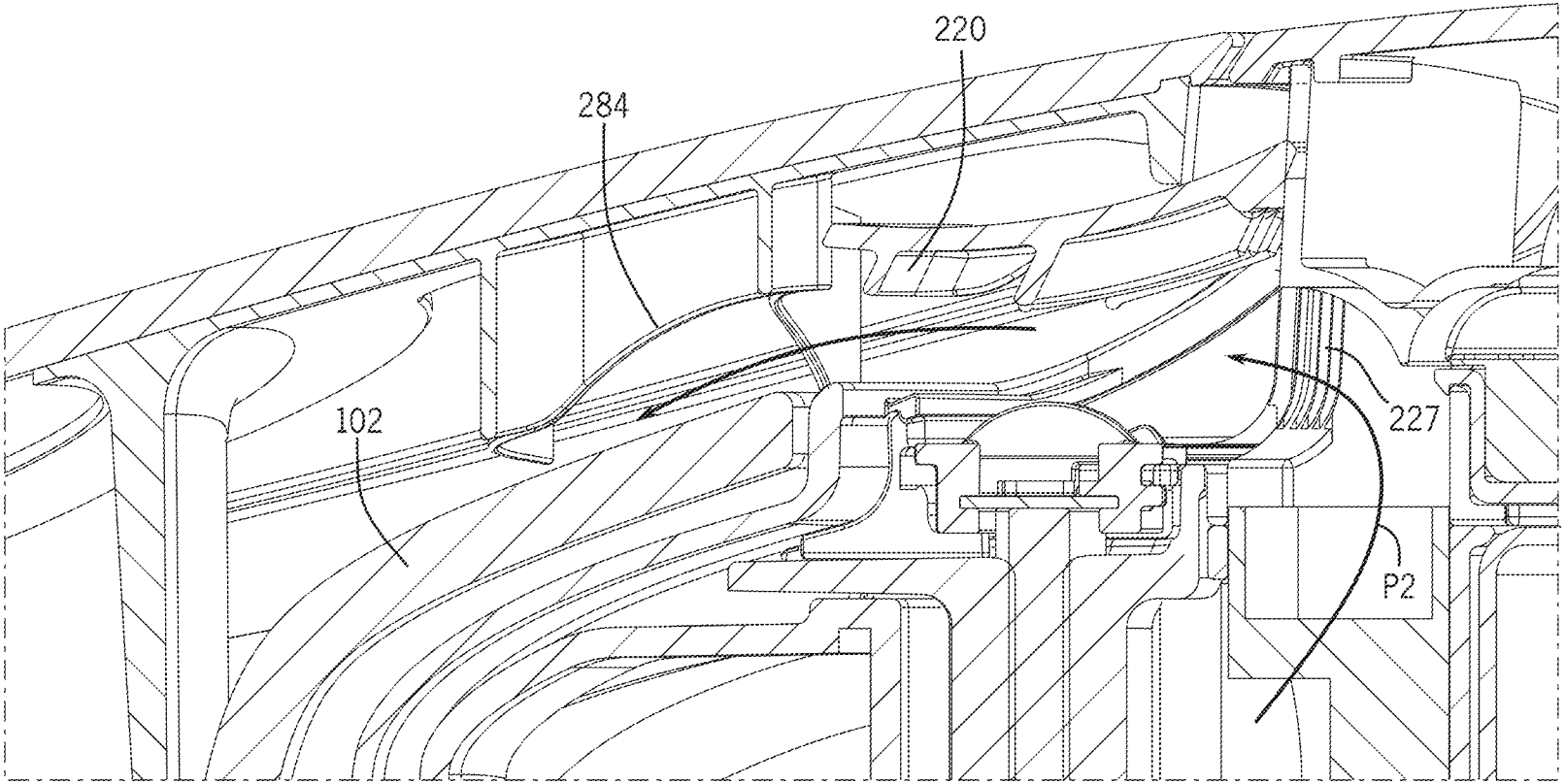
FIG. 31 illustrates example air vents.

FIG. 31 illustrates an example air path P2 that illustrates as air passes through example air vents 227, the air is directed across the bottom of cover 222, which causes the air movement to arc to a horizontal direction. After the bottom of cover 222, the air passes to arc feature 284 on the housing of the toilet seat assembly 200, which further turns the flow of air downward toward the seat 102.

Figure 32:
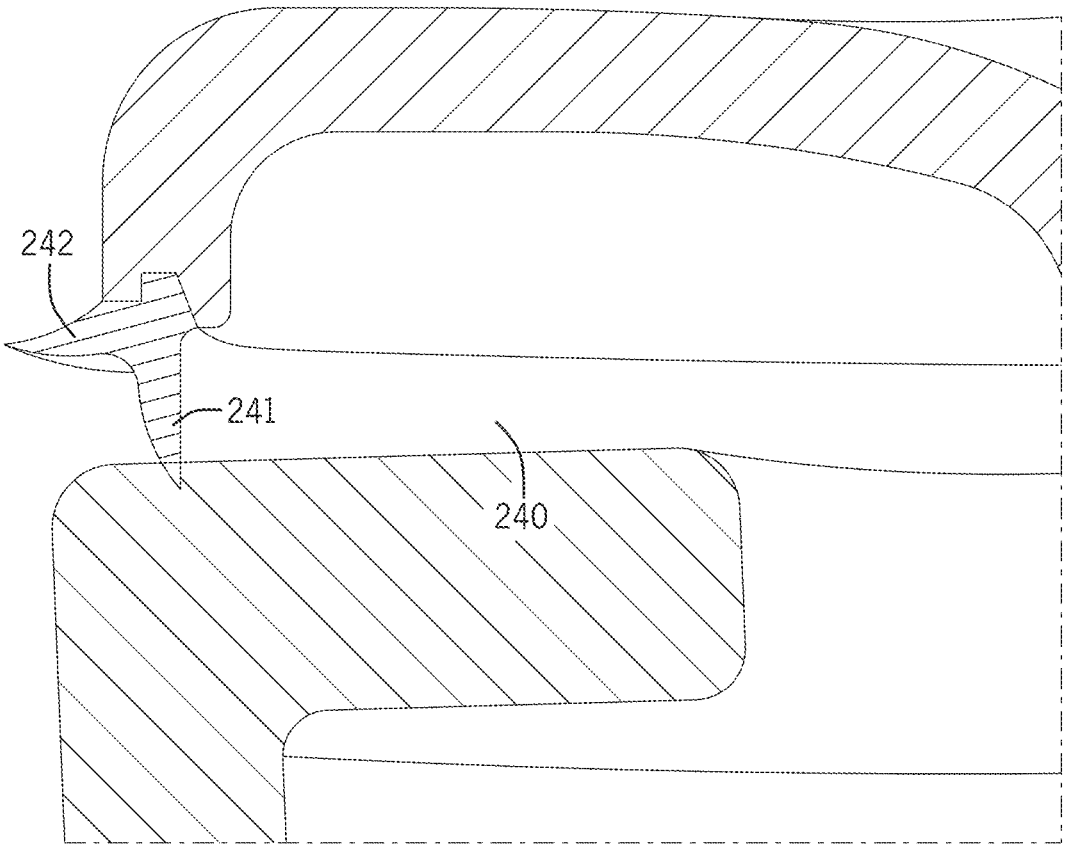
FIG. 32 illustrates another example seal for the toilet seat.

FIG. 32 illustrates another example seal 240 for the toilet seat. The seal may have two parts. A first part extends between the seat 102 and the bowl. A second part extends between the seat 102 and the lid 101. Each part includes respective curved components 241 and 242. The curved components 241 and 242 aid in sealing as the seat 102 is moved with respect to the bowl and lid 101.

Figure 33:
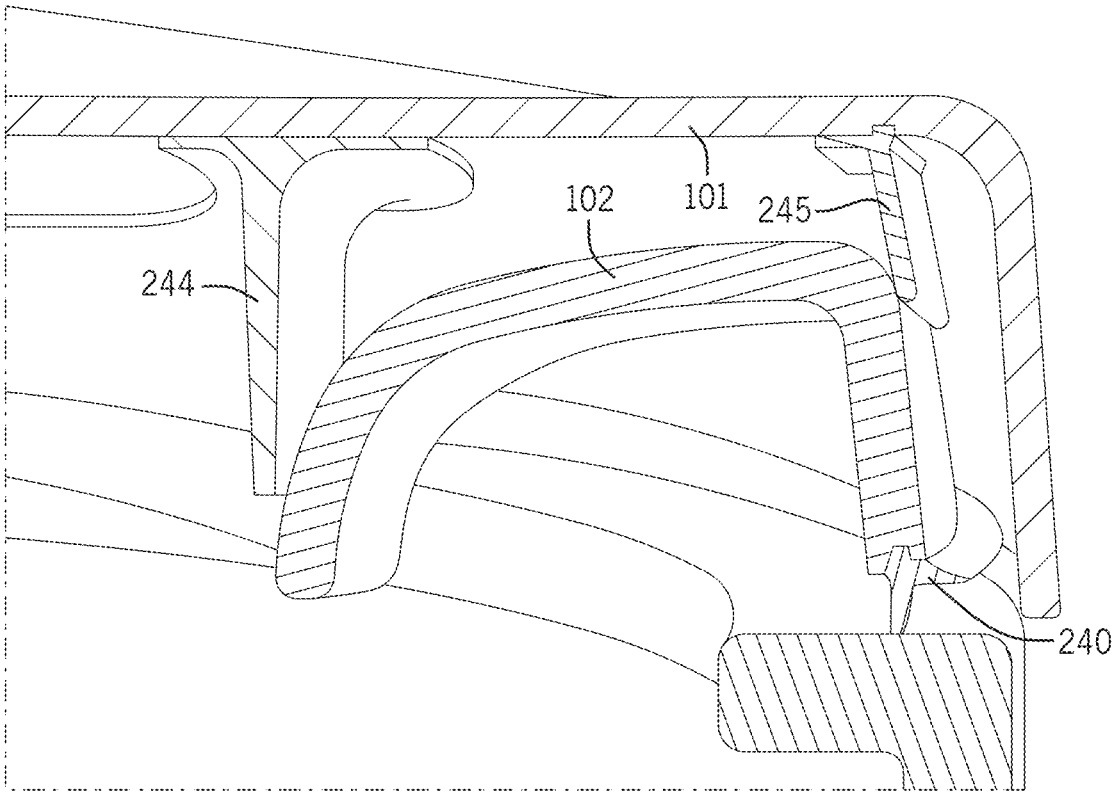
FIG. 33 illustrates a vent space between the toilet seat and toilet lid.

FIG. 33 illustrates a vent space between the toilet seat 102 and toilet lid 101. The seal 240 prevents the plume from the toilet bowl from escaping into the environment. The vent space includes three seals. Seal 244 and 245 define the sanitizing space for the seat 102 where the mist air flow is directed. Seal 240 may extend to the lid 101 and create a seal with the lid 101. Seal 240 may not span the entire gap between the lid 101 and the seat 102.

Figure 34:
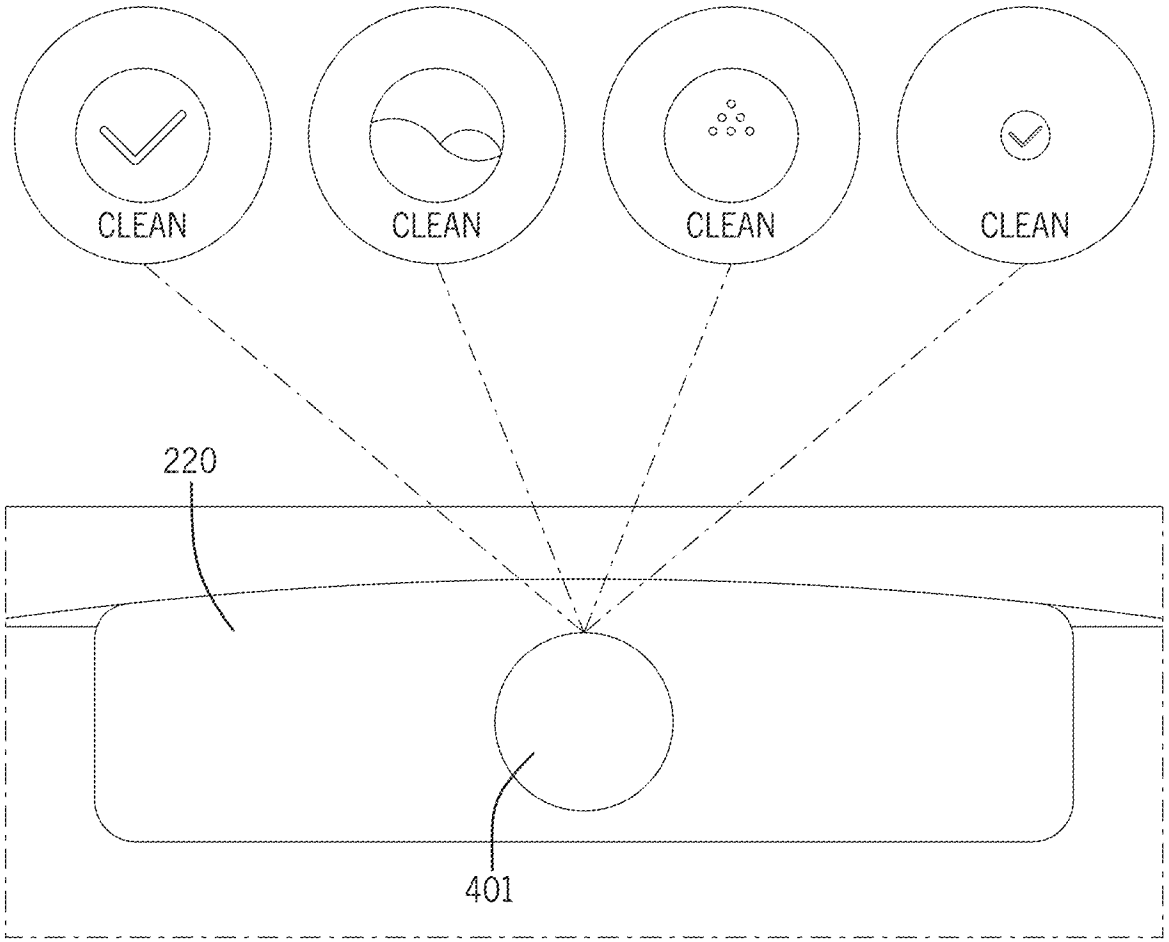
FIG. 34 illustrates an example display for the toilet seat assembly.

FIG. 34 illustrates a display 401 for the toilet seat assembly 200. The display 401 may be on the cover 220. The display 401 may be adjacent to the cover 220 on the lid of the toilet seat assembly 200. The display 401 may be on the hinge section.

A variety of information may be relayed to the user by the display 401. In a simple example, the display 401 includes a single light that illuminated to indicate that the toilet seat assembly 200 is ready for use. In another example, the display 401 may include a countdown timer until the toilet seat assembly 200 is ready for use (e.g., the surface of the seat 100 is dry or expected to be dry). Example timers may include 30 seconds, 1 minute, and 5 minutes.

In another example, the display 401 may include an array or matrix of lights (e.g., LEDs). Various images may be formed with the matrix of lights as illustrated in FIG. 34. A first image may indicate ready for use. A second image may indicate cleaning in progress. Another image may indicate drying in progress. Another image may indicate time since last cleaning. The images may be part of an animation or video. In another example, a circular indicator gives a status or progress bar for the cleaning process. The circular indicator may be illuminated by several LEDs arranged in a ring.

The display 401 may include an indicator for the level of sanitizing fluid in the tank 210. The display 401 may instruct the user to refill the tank 210. The display 401 may include an indicator of energy usage, battery life, or other electrical parameters. The display 401 may indicate the mode. The display 401 may indicate what devices or in operation (e.g., fan 207, atomizer 209, etc.).

Figure 35:
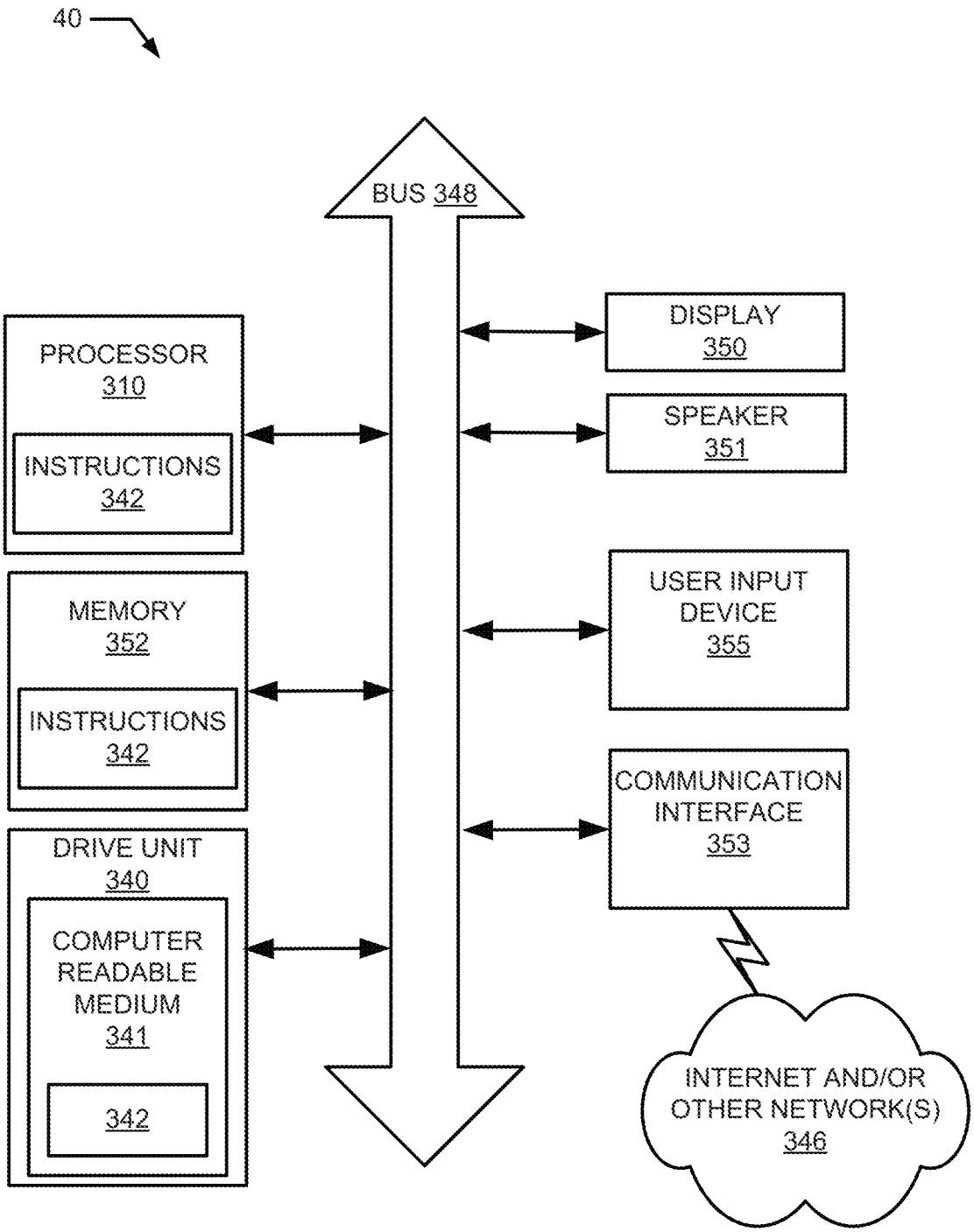
FIG. 35 illustrates a controller for the toilet seat assembly.

FIG. 35 illustrates a controller 40 for the toilet seat assembly. The controller 40 may include a processor 310, a memory 352, and a communication interface 353 for interfacing with devices or to the internet and/or other networks 346. In addition to the communication interface 353, a sensor interface may be configured to receive data from the sensors described herein or data from any source. The components of the control system 40 may communicate using bus 348. The control system 40 may be connected to a workstation or another external device (e.g., control panel) and/or a database for receiving user inputs, system characteristics, and any of the values described herein.

Optionally, the control system 40 may include an input device 355 and/or a sensing circuit in communication with any of the sensors. The sensing circuit receives sensor measurements from as described above. The input device 355 may include a switch, a button, a flush lever, a touchscreen, a keyboard, a microphone for voice inputs, a camera for gesture inputs, and/or another mechanism.

Optionally, the control system 40 may include a drive unit 340 for receiving and reading non-transitory computer media 341 having instructions 342. Additional, different, or fewer components may be included. The processor 310 is configured to perform instructions 342 stored in memory 352 for executing the algorithms described herein. The display 350 may be combined with the user input device 355.

Figure 36:
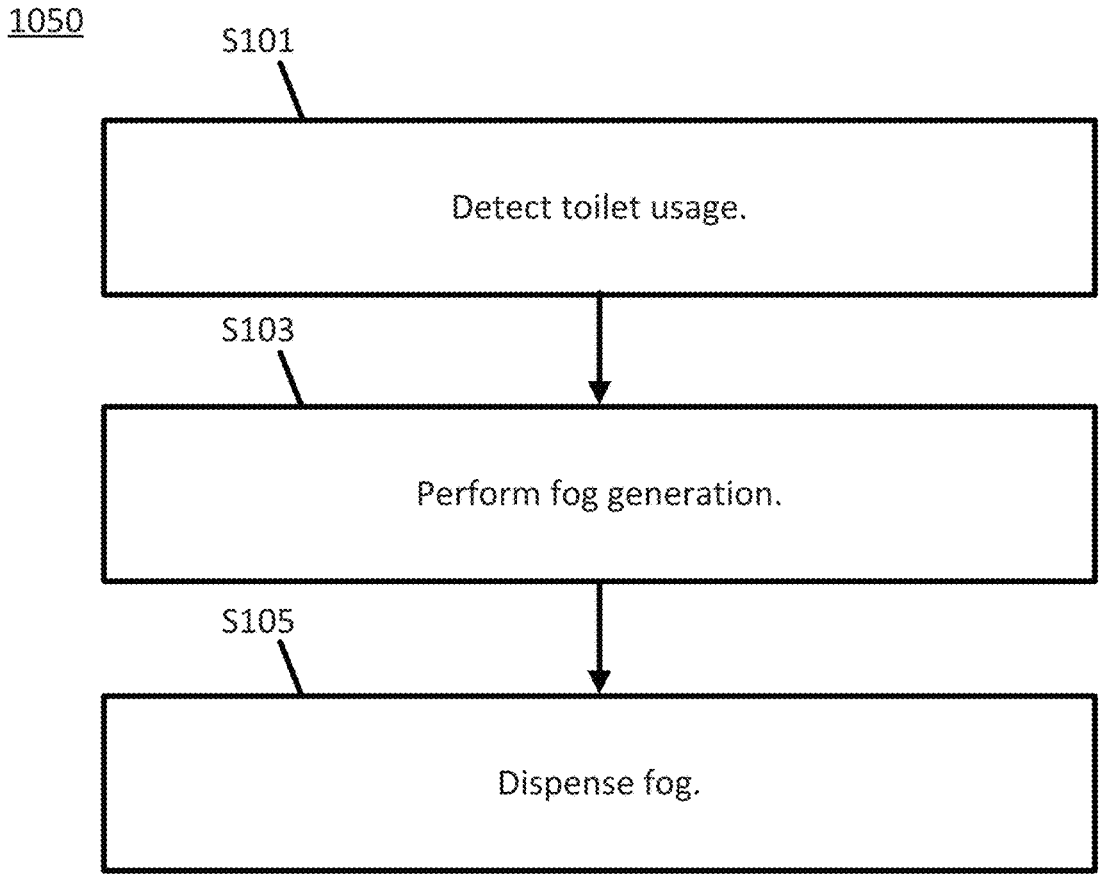
FIG. 36 illustrates a flow chart for the controller of FIG. 35.

FIG. 36 illustrates a flow chart 1050 for the controller of FIG. 35. Additional, different of fewer acts may be included. At act S101, the controller 40 (e.g., through processor 310) receives usage information related to the toilet bowl. The usage information may be a button pressed by the user. The usage information may be detected from a flush cycle. The usage information may be detected through movement of the toilet seat 100 or lid 101.

At act S103, the controller 40 causes a misting generation operation for the toilet seat assembly. The misting generation operation may generate the sanitizing fluid. At act S105, the controller 40 performs dispensing operation mitigation operation at the toilet seat assembly. The dispensing operation may be triggered by operation of a fan. The dispensing operation may be triggered by the opening of a valve.

Figure 37:
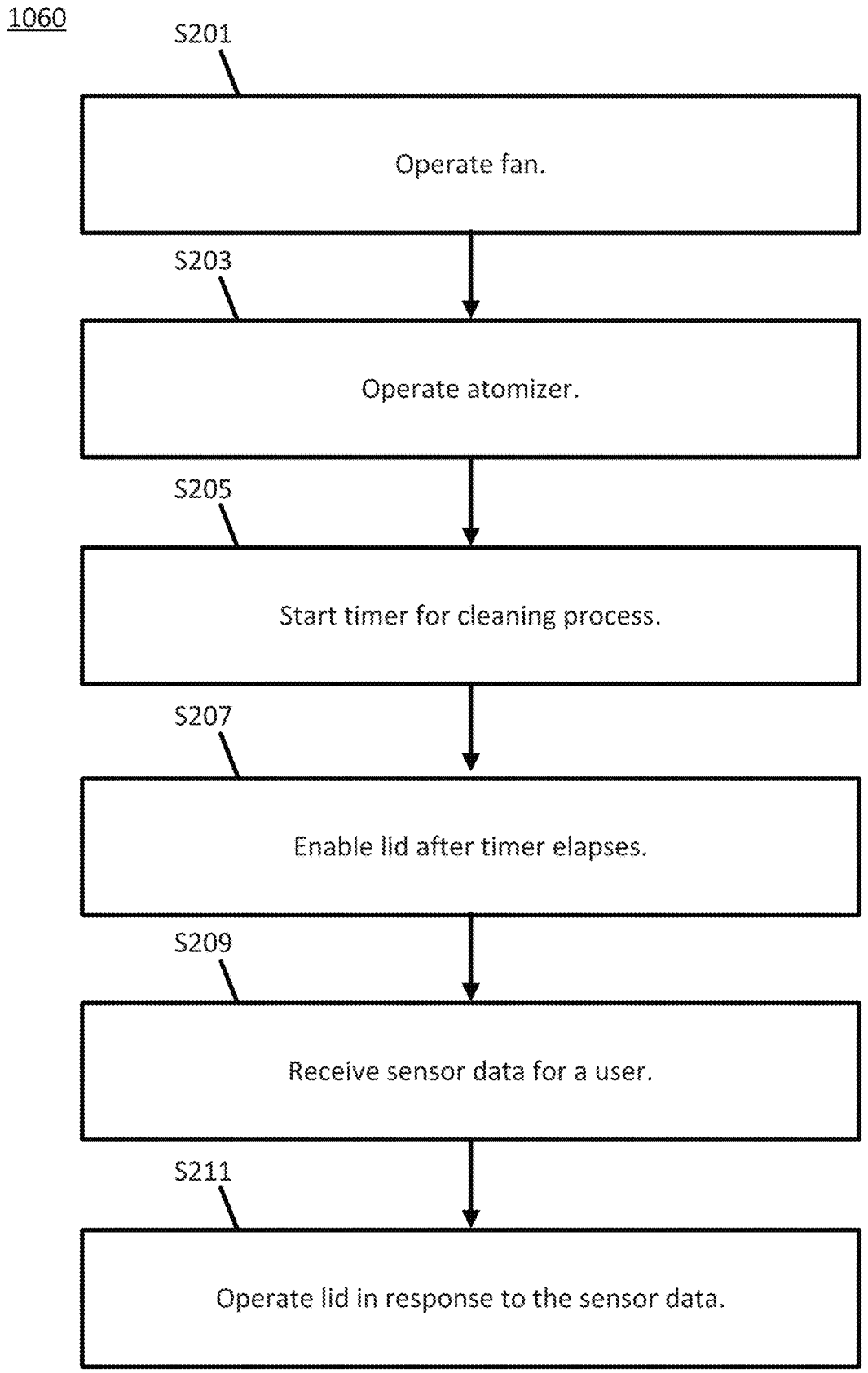
FIG. 37 illustrates a flow chart for the controller of FIG. 35.

FIG. 37 illustrates a flow chart 1060 for the controller of FIG. 35. Additional, different, or fewer acts may be included.

At act S201, the controller 40 provides or causes the power supply to provide electrical current to a fan for a sanitizer path. The fan may be operated as part of a cleaning sequence. The fan may be operated at all parts of the cleaning sequence.

The cleaning sequence may be triggered in a variety of techniques. The cleaning sequence may start from a flush sequence. The controller 40 may determine that the flush sequence has started from a signal from an electronic flush lever. The controller 40 may determine that the flush sequence has started from sensor data, such as a flow sensor, tank water level sensor, bowl sensor, or another sensor. The cleaning sequence may start from a button or other input on the toilet seat assembly 200.

At act S203, the controller 40 provides or causes the power supply to provide electrical current to an atomizer that sprays sanitizer in the sanitizer path. In some examples, the atomizer is operated after the fan starts to operate and the air flow has some time to circulate. In other examples, the atomizer may be operated at all parts of the cleaning sequence. The sanitizer path may be opened in response to opening of a lid of the toilet seat assembly.

At act S205, the controller 40 starts a timer for a cleaning process. The timer may be a predetermined amount of time selected for the cleaning sequence. The timer may be used to turn off the fan and atomizer at certain times. The controller 40 may turn off the atomizer when the time reaches a first threshold. The controller 40 may turn off the fan when the time reaches a second threshold.

At act S207, the controller 40 enables lid operation after the timer elapses a final cleaning sequence threshold. Enabling the lid may include operating the motor to open the lid. Enabling the lid may mean unlocking the lid so that the user can press a button to open the lid or manually grip and open the lid. The following steps involve automatic opening of the lid.

At act S209, the controller 40 receives sensor data for a user. The sensor data may indicate that a user has approached the toilet or has made a gesture to open the lid.

The sensor data may be generated at a proximity sensor. At act S211, the controller 40 operates the lid in response to the sensor data by providing electrical current to the motor.

Processor 310 may be a general purpose or specific purpose processor, an application specific integrated circuit (ASIC), one or more programmable logic controllers (PLCs), one or more field programmable gate arrays (FPGAs), a group of processing components, or other suitable processing components. Processor 310 is configured to execute computer code or instructions stored in memory 352 or received from other computer readable media (e.g., embedded flash memory, local hard disk storage, local ROM, network storage, a remote server, etc.). The processor 310 may be a single device or combinations of devices, such as associated with a network, distributed processing, or cloud computing.

Memory 352 may include one or more devices (e.g., memory units, memory devices, storage devices, etc.) for storing data and/or computer code for completing and/or facilitating the various processes described in the present disclosure. Memory 352 may include random access memory (RAM), read-only memory (ROM), hard drive storage, temporary storage, non-volatile memory, flash memory, optical memory, or any other suitable memory for storing software objects and/or computer instructions. Memory 352 may include database components, object code components, script components, or any other type of information structure for supporting the various activities and information structures described in the present disclosure. Memory 352 may be communicably connected to processor 310 via a processing circuit and may include computer code for executing (e.g., by processor 310) one or more processes described herein. For example, memory 298 may include graphics, web pages, HTML files, XML files, script code, shower configuration files, or other resources for use in generating graphical user interfaces for display and/or for use in interpreting user interface inputs to make command, control, or communication decisions.

In addition to ingress ports and egress ports, the communication interface 353 may include any operable connection. An operable connection may be one in which signals, physical communications, and/or logical communications may be sent and/or received. An operable connection may include a physical interface, an electrical interface, and/or a data interface. The communication interface 353 may be connected to a network. The network may include wired networks (e.g., Ethernet), wireless networks, or combinations thereof. The wireless network may be a cellular telephone network, an 802.11, 802.16, 802.20, or WiMax network, a Bluetooth pairing of devices, or a Bluetooth mesh network. Further, the network may be a public network, such as the Internet, a private network, such as an intranet, or combinations thereof, and may utilize a variety of networking protocols now available or later developed including, but not limited to TCP/IP based networking protocols.

While the computer-readable medium (e.g., memory 352) is shown to be a single medium, the term "computer-readable medium" includes a single medium or multiple media, such as a centralized or distributed database, and/or associated caches and servers that store one or more sets of instructions. The term "computer-readable medium" shall also include any medium that is capable of storing, encoding or carrying a set of instructions for execution by a processor or that cause a computer system to perform any one or more of the methods or operations disclosed herein.

In a particular non-limiting, exemplary embodiment, the computer-readable medium can include a solid-state memory such as a memory card or other package that houses one or more non-volatile read-only memories. Further, the computer-readable medium can be a random access memory or other volatile re-writable memory. Additionally, the computer-readable medium can include a magneto-optical or optical medium, such as a disk or tapes or other storage device to capture carrier wave signals such as a signal communicated over a transmission medium. A digital file attachment to an e-mail or other self-contained information archive or set of archives may be considered a distribution medium that is a tangible storage medium. Accordingly, the disclosure is considered to include any one or more of a computer-readable medium or a distribution medium and other equivalents and successor media, in which data or instructions may be stored. The computer-readable medium may be non-transitory, which includes all tangible computer-readable media.

In an alternative embodiment, dedicated hardware implementations, such as application specific integrated circuits, programmable logic arrays and other hardware devices, can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

What is claimed is:

1. A toilet seat assembly configured to enclose a toilet bowl, the toilet seat assembly comprising:
- a lid;
- a toilet seat rotatably connected to the toilet bowl via a hinge;
- a hinge seal configured to seal a space between the toilet seat and a rim of the toilet bowl, the hinge seal connected to the hinge;
- a protrusion operable by the lid at a predetermined position to release a sanitizing material into the toilet bowl; and
- a fan configured to assist flow of the sanitizing material.

2. The toilet seat assembly of claim 1, further comprising:
- a tank; and
- a valve operable in a first position to at least partially prevent the sanitizing material from exiting the tank and a second position to release the sanitizing material into the toilet bowl when engaged by the protrusion.

3. The toilet seat assembly of claim 2, further comprising:
- a flow limiter integrated with the valve, the flow limiter configured to meter the sanitizing material flowing into the toilet bowl.

4. The toilet seat assembly of claim 2, further comprising:
- a drain cap connected to the tank to provide a service entry point and to drain the tank.

5. The toilet seat assembly of claim 4, further comprising:
- a wicking material connecting to the drain cap to assist in a flow of the sanitizing material.

6. The toilet seat assembly of claim 1, further comprising:
- a hinge plate including at least one orifice to deliver the sanitizing material to the toilet bowl.

7. A toilet seat assembly configured to enclose a toilet bowl, the toilet seat assembly comprising:
- a toilet seat rotatably connected to the toilet bowl via a hinge;

a fan configured to direct a flow of air into a hinge structure;

a wick compartment in the hinge structure, the wick compartment including a sanitizing fluid;

an atomizer configured to spray fine particles of the sanitizing fluid into the flow of air from the fan; and at least one fin configured to direct the flow of air including the fine particles of the sanitizing fluid toward a surface of the toilet seat.

8. The toilet seat assembly of claim 7, further comprising:

a hinge seal configured to seal a space between the toilet seat and a rim of the toilet bowl, the hinge seal connected to the hinge; and a protrusion operable by a lid connected to the toilet seat at a predetermined position to release a sanitizing material into the toilet bowl.

9. The toilet seat assembly of claim 7, further comprising:

a tank for the sanitizing fluid in communication with the wick compartment.

10. The toilet seat assembly of claim 7, further comprising:

a dial configured to drain or close the wick compartment.

11. The toilet seat assembly of claim 7, further comprising:

a slider configured to select a mode for the toilet seat assembly.

12. The toilet seat assembly of claim 11, wherein the mode includes an automatic opening mode for the toilet seat assembly.

13. The toilet seat assembly of claim 11, wherein the mode includes a presence only opening mode for the toilet seat assembly.

14. The toilet seat assembly of claim 11, wherein the mode includes a maintenance mode.

15. The toilet seat assembly of claim 7, further comprising:

a scent module including a scented material.

16. The toilet seat assembly of claim 15, further comprising:

a split configured to divide the flow of air between the scent module and an area adjacent to the atomizer.

17. A toilet seat assembly configured to enclose a toilet bowl, the toilet seat assembly comprising:

a lid;

a toilet seat rotatably connected to the toilet bowl via a hinge;

a hinge seal configured to seal a space between the toilet seat and a rim of the toilet bowl, the hinge seal connected to the hinge;

a protrusion operable by the lid at a predetermined position to release a sanitizing material into the toilet bowl;

a drain cap connected to the tank to provide a service entry point and to drain the tank; and a wicking material connecting to the drain cap to assist in a flow of the sanitizing material.

* * * * *